US011017714B2

(12) United States Patent
Park

(10) Patent No.: US 11,017,714 B2
(45) Date of Patent: May 25, 2021

(54) SCAN DRIVER AND DISPLAY DEVICE INCLUDING THE SAME

(71) Applicant: Samsung Display Co., LTD., Yongin-si (KR)

(72) Inventor: Kyung Ho Park, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 17/023,264

(22) Filed: Sep. 16, 2020

(65) Prior Publication Data

US 2021/0090491 A1 Mar. 25, 2021

(30) Foreign Application Priority Data

Sep. 20, 2019 (KR) ..... 10-2019-0116091

(51) Int. Cl.
*G09G 3/32* (2016.01)

(52) U.S. Cl.
CPC ..... *G09G 3/32* (2013.01); *G09G 2300/0426* (2013.01); *G09G 2300/08* (2013.01);
(Continued)

(58) Field of Classification Search
CPC ..... G09G 3/32; G09G 2310/0267; G09G 2330/02; G09G 2300/08;
(Continued)

(56) References Cited

U.S. PATENT DOCUMENTS 7,982,813 B2 * 7/2011 Kim ..... G02F 1/136204 349/43
9,024,857 B2 * 5/2015 Ahn ..... G09G 3/3677 345/100

(Continued)

FOREIGN PATENT DOCUMENTS

KR 10-2014-0068569 6/2014
KR 10-2016-0073928 6/2016

(Continued)

*Primary Examiner* — Andrew Sasinowski
(74) *Attorney, Agent, or Firm* — H.C. Park & Associates, PLC

(57) ABSTRACT

A scan driver for display device includes: a plurality of stage groups each including a first stage and a second stage spaced apart from the first stage in a first direction; and a first power line extending in the first direction, the first power line being commonly electrically connected to the plurality of stage groups. The first power line includes a first branch line extending in a second direction crossing the first direction between the first stage and the second stage, and the first branch line is electrically connected to the first stage and the second stage. The first stage includes a first transistor including a first electrode connected to a first scan line and a second transistor including a first electrode connected to a first sensing line, and the second stage includes a third transistor including a first electrode connected to a second scan line and a fourth transistor including a first electrode connected to a second sensing line. The first transistor, the second transistor, the third transistor, and the fourth transistor disposed one after the other in the first direction.

18 Claims, 9 Drawing Sheets

(52) U.S. Cl.
CPC ..... *G09G 2310/027* (2013.01); *G09G 2310/0267* (2013.01); *G09G 2310/0286* (2013.01); *G09G 2310/08* (2013.01); *G09G 2330/02* (2013.01)

(58) Field of Classification Search
CPC ..... G09G 2300/0426; G09G 2310/08; G09G 2310/027; G09G 2310/0286
See application file for complete search history.

(56) References Cited

U.S. PATENT DOCUMENTS

| | | | | |
|---|---|---|---|---|
| 9,953,580 | B2 | 4/2018 | Kuang et al. | |
| 2005/0083292 | A1* | 4/2005 | Moon | G09G 3/3685 345/100 |
| 2008/0018572 | A1* | 1/2008 | Shin | G02F 1/1345 345/87 |
| 2009/0122213 | A1* | 5/2009 | Ko | G09G 3/3677 349/46 |
| 2011/0279358 | A1* | 11/2011 | Lee | G09G 3/3677 345/87 |
| 2012/0139881 | A1* | 6/2012 | Kwon | G09G 3/3677 345/204 |
| 2018/0182748 | A1* | 6/2018 | Han | G09G 3/3674 |

FOREIGN PATENT DOCUMENTS

| | | |
|---|---|---|
| KR | 10-2017-0040866 | 4/2017 |
| KR | 10-2018-0038520 | 4/2018 |

* cited by examiner

SCAN DRIVER AND DISPLAY DEVICE INCLUDING THE SAME

CROSS-REFERENCE TO RELATED APPLICATION

This application claims priority from and the benefit of Korean Patent Application No. 10-2019-0116091 filed on Sep. 20, 2019, which is hereby incorporated by reference for all purposes as if fully set forth herein.

BACKGROUND

Field

Exemplary implementations of the invention relate generally to a display device, and more specifically, to a scan driver included in the display device for outputting a scan signal and a sensing signal.

Discussion of the Background

With the development of information technologies, the importance of a display device which is a connection medium between a user and information has increased. Accordingly, display devices such as a liquid crystal display device, an organic light emitting display device, and plasma display devices are increasingly used.

Each pixel of a display device may emit light with a luminance corresponding to a data voltage supplied through a data line. The display device may display an image with a combination of lights emitting pixels.

A plurality of pixels may be connected to each data line. Therefore, a scan driver is required to provide a scan signal for selecting a pixel to which a data voltage is to be supplied among the plurality of pixels. The scan driver may be provided in the form of a shift register, to sequentially provide a scan signal of a turn-on level via a plurality of scan lines.

The above information disclosed in this Background section is only for understanding of the background of the inventive concepts, and, therefore, it may contain information that does not constitute prior art.

SUMMARY

Applicant discovered that a scan driver capable of selectively providing a turn-on level scan signal to only a desired scan line may be desirable, for example, so as to detect mobility information or threshold voltage information of a driving transistor of a pixel.

Scan drivers and display devices incorporating the same constructed according to the principles and exemplary implementations of the invention are capable of decreasing the space required to accommodate the scan driver in the device since adjacent stages can share a power line.

Scan drivers and display devices incorporating the same constructed according to the principles and exemplary embodiments of the invention are capable of decreasing errors and a defect rate by reducing or preventing crosstalk between a scan line and an adjacent sensing line.

Additional features of the inventive concepts will be set forth in the description which follows, and in part will be apparent from the description, or may be learned by practice of the inventive concepts.

According to an aspect of the invention, a scan driver includes: a plurality of stage groups each including a first stage and a second stage spaced apart from the first stage in a first direction; and a first power line extending in the first direction, the first power line being electrically commonly connected to the plurality of stage groups, wherein the first power line includes a first branch line extending in a second direction intersecting the first direction between the first stage and the second stage, and the first branch line is electrically connected to the first stage and the second stage, wherein the first stage includes a first transistor including a first electrode connected to a first scan line and a second transistor including a first electrode connected to a first sensing line, and the second stage includes a third transistor including a first electrode connected to a second scan line and a fourth transistor including a first electrode connected to a second sensing line, wherein the first transistor, the second transistor, the third transistor, and the fourth transistor are sequentially disposed one after the other in the first direction.

The first scan line, the first sensing line, the second scan line, and the second sensing line may be substantially parallel without intersecting each other.

The first stage may further include a fifth transistor including a first electrode electrically connected to the first power line by the first branch line, a second electrode connected to the first electrode of the first transistor, and a gate electrode connected to a first node, and the second stage may further include a sixth transistor including a first electrode electrically connected to the first power line by the first branch line, a second electrode connected to the first electrode of the third transistor, and a gate electrode connected to the first node.

The first stage may further include a seventh transistor including a first electrode electrically connected to the first power line by the first branch line, a second electrode connected to the first electrode of the first transistor, and a gate electrode connected to a second node, and the second stage may further include an eighth transistor including a first electrode electrically connected to the first power line by the first branch line, a second electrode connected to the first electrode of the third transistor, and a gate electrode connected to the second node.

The first stage may further include a ninth transistor including a first electrode electrically connected to the first power line by the first branch line, a second electrode connected to the first electrode of the second transistor, and a gate electrode connected to the first node, and the second stage may further include a tenth transistor including a first electrode electrically connected to the first power line by the first branch line, a second electrode connected to the first electrode of the fourth transistor, and a gate electrode connected to the first node.

The first stage may further include an eleventh transistor including a first electrode electrically connected to the first power line by the first branch line, a second electrode connected to the first electrode of the second transistor, and a gate electrode connected to the second node, and the second stage may further include a twelfth transistor including a first electrode electrically connected to the first power line by the first branch line, a second electrode connected to the first electrode of the fourth transistor, and a gate electrode connected to the second node.

The first stage may further include: a thirteenth transistor including a first electrode connected to a first carry line; a fourteenth transistor including a first electrode connected to a second power line, a second electrode connected to the first electrode of the thirteenth transistor, and a gate electrode connected to the first node; and a fifteenth transistor including a first electrode connected to the second power line, a second electrode connected to the first electrode of the thirteenth transistor, and a gate electrode connected to the second node.

The second stage may further include: a sixteenth transistor including a first electrode connected to a second carry line; a seventeenth transistor including a first electrode connected to the second power line, a second electrode connected to the first electrode of the sixteenth transistor, and a gate electrode connected to the first node; and an eighteenth transistor including a first electrode connected to the second power line, a second electrode connected to the first electrode of the sixteenth transistor, and a gate electrode connected to the second node.

A gate electrode of the first transistor, a gate electrode of the second transistor, and a gate electrode of the thirteenth transistor may be connected to a third node.

A gate electrode of the third transistor, a gate electrode of the fourth transistor, and a gate electrode of the sixteenth transistor may be connected to a fourth node.

According to another aspect of the invention, a display device includes: a first pixel connected to a first data line; a second pixel connected to the first data line, the second pixel being spaced apart from the first pixel in a first direction; a plurality of stage groups each including a first stage and a second stage spaced apart from the first stage in the same first direction; and a first power line extending in the first direction, wherein the first power line being electrically commonly connected to the plurality of stage groups, the first power line includes a first branch line extending in a second direction intersecting the first direction between the first stage and the second stage, and the first branch line is connected to the first stage and the second stage, wherein the first stage includes a first transistor including a first electrode connected to a first scan line and a second transistor including a first electrode connected to a first sensing line, and the second stage includes a third transistor including a first electrode connected to a second scan line and a fourth transistor including a first electrode connected to a second sensing line, wherein the first transistor, the second transistor, the third transistor, and the fourth transistor are sequentially disposed one after the other in the first direction, wherein the first scan line and the first sensing line are connected to the first pixel, and the second scan line and the second sensing line are connected to the second pixel.

The first scan line, the first sensing line, the second scan line, and the second sensing line may be substantially parallel without intersecting each other.

The first stage may further include a fifth transistor including a first electrode electrically connected to the first power line by the first branch line, a second electrode connected to the first electrode of the first transistor, and a gate electrode connected to a first node, and the second stage may further include a sixth transistor including a first electrode electrically connected to the first power line by the first branch line, a second electrode connected to the first electrode of the third transistor, and a gate electrode connected to the first node.

The first stage may further include a seventh transistor including a first electrode electrically connected to the first power line by the first branch line, a second electrode connected to the first electrode of the first transistor, and a gate electrode connected to a second node, and the second stage may further include an eighth transistor including a first electrode electrically connected to the first power line by the first branch line, a second electrode connected to the first electrode of the third transistor, and a gate electrode connected to the second node.

The first stage may further include a ninth transistor including a first electrode electrically connected to the first power line by the first branch line, a second electrode connected to the first electrode of the second transistor, and a gate electrode connected to the first node, and the second stage may further include a tenth transistor including a first electrode electrically connected to the first power line by the first branch line, a second electrode connected to the first electrode of the fourth transistor, and a gate electrode connected to the first node.

The first stage may further include an eleventh transistor including a first electrode electrically connected to the first power line by the first branch line, a second electrode connected to the first electrode of the second transistor, and a gate electrode connected to the second node, and the second stage may further include a twelfth transistor including a first electrode electrically connected to the first power line by the first branch line, a second electrode connected to the first electrode of the fourth transistor, and a gate electrode connected to the second node.

The first stage may further include: a thirteenth transistor including a first electrode connected to a first carry line; a fourteenth transistor including a first electrode connected to a second power line, a second electrode connected to the first electrode of the thirteenth transistor, and a gate electrode connected to the first node; and a fifteenth transistor including a first electrode connected to the second power line, a second electrode connected to the first electrode of the thirteenth transistor, and a gate electrode connected to the second node.

The second stage may further include: a sixteenth transistor including a first electrode connected to a second carry line; a seventeenth transistor including a first electrode connected to the second power line, a second electrode connected to the first electrode of the sixteenth transistor, and a gate electrode connected to the first node; and an eighteenth transistor including a first electrode connected to the second power line, a second electrode connected to the first electrode of the sixteenth transistor, and a gate electrode connected to the second node.

A gate electrode of the first transistor, a gate electrode of the second transistor, and a gate electrode of the thirteenth transistor may be connected to a third node.

A gate electrode of the third transistor, a gate electrode of the fourth transistor, and a gate electrode of the sixteenth transistor may be connected to a fourth node.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the inventive concepts.

DETAILED DESCRIPTION

Figure 1:
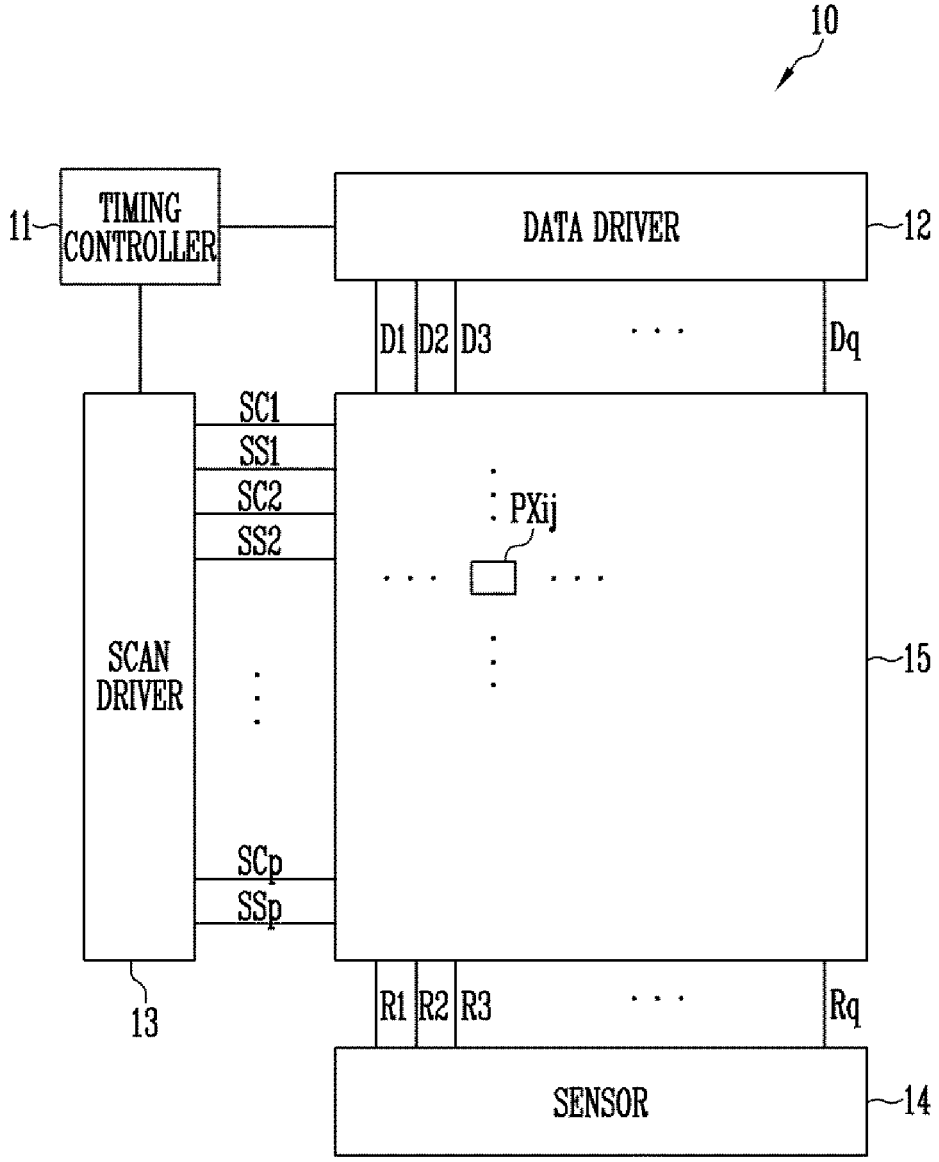
FIG. 1 is a block diagram of an exemplary embodiment of a display device constructed according to the principles of the invention.

In the following description, for the purposes of explanation, numerous specific details are set forth in order to provide a thorough understanding of various exemplary embodiments or implementations of the invention. As used herein "embodiments" and "implementations" are interchangeable words that are non-limiting examples of devices or methods employing one or more of the inventive concepts disclosed herein. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments. Further, various exemplary embodiments may be different, but do not have to be exclusive. For example, specific shapes, configurations, and characteristics of an exemplary embodiment may be used or implemented in another exemplary embodiment without departing from the inventive concepts.

Unless otherwise specified, the illustrated exemplary embodiments are to be understood as providing exemplary features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified. Further, in the accompanying drawings, the size and relative sizes of elements may be exaggerated for clarity and/or descriptive purposes. When an exemplary embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. Further, the D1-axis, the D2-axis, and the D3-axis are not limited to three axes of a rectangular coordinate system, such as the x, y, and z-axes, and may be interpreted in a broader sense. For example, the D1-axis, the D2-axis, and the D3-axis may be perpendicular to one another, or may represent different directions that are not perpendicular to one another. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

FIG. 1 is a block diagram of an exemplary embodiment of a display device constructed according to the principles of the invention.

Referring to FIG. 1, the display device 10 may include a timing controller 11, a data driver 12, a scan driver 13, a sensor 14, and a pixel unit 15.

The timing controller 11 may provide grayscale values for each frame, a control signal, and the like to the data driver 12. Also, the timing controller 11 may provide a clock signal, a control signal, and the like to each of the scan driver 13 and the sensor 14.

The data driver 12 may generate data voltages to be provided to data lines D1, D2, D3, . . . , and Dq by using the grayscale values, the control signal, and the like, which are received from the timing controller 11. For example, the data driver 12 may sample grayscale values by using a clock signal, and apply data voltages corresponding to the grayscale values to data lines D1 to Dq in a unit of a pixel rows (e.g., pixels connected to the same scan line). Here, q may be an integer greater than 0.

The scan driver 13 may generate scan signals to be provided to scan lines SC1, SC2, . . . , and SCp by receiving the clock signal, the control signal, and the like from the timing controller 11. For example, the scan driver 13 may sequentially provide scan signals having a pulse of a turn-on level to the scan lines SC1 to SCp. For example, one frame may include one display period and one sensing period, and the scan driver 13 may generate scan signals in a manner that sequentially transfers a pulse of a turn-on level to a next scan stage in response to the clock signal during the display period. Here, p may be an integer greater than 0. For example, the scan driver 13 may be configured in a shift register form.

Also, the scan driver 13 may generate sensing signals to be provided to sensing lines SS1, SS2, . . . , and SSp. For example, the scan driver 13 may sequentially provide sensing signals having a pulse of a turn-on level to the sensing lines SS1 to SSp during the display period. For example, the scan driver 13 may generate sensing signals in a manner that sequentially transfers a pulse of a turn-on level to a next stage in response to the clock signal.

Figure 4:
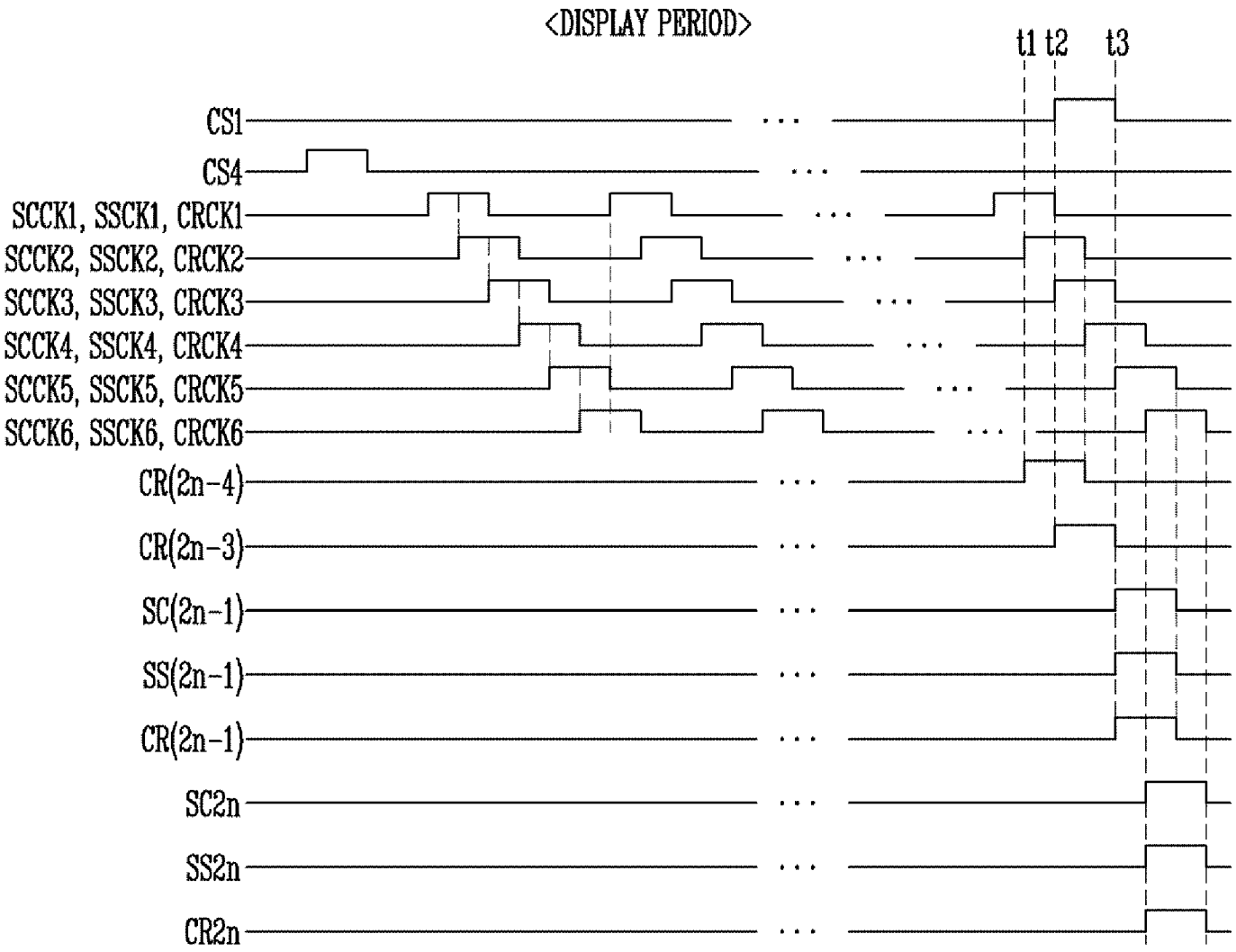
FIG. 4 is an exemplary timing diagram illustrating an example of an operation in a display period of the first scan stage and the second scan stage shown in FIG. 3.
Figure 7:
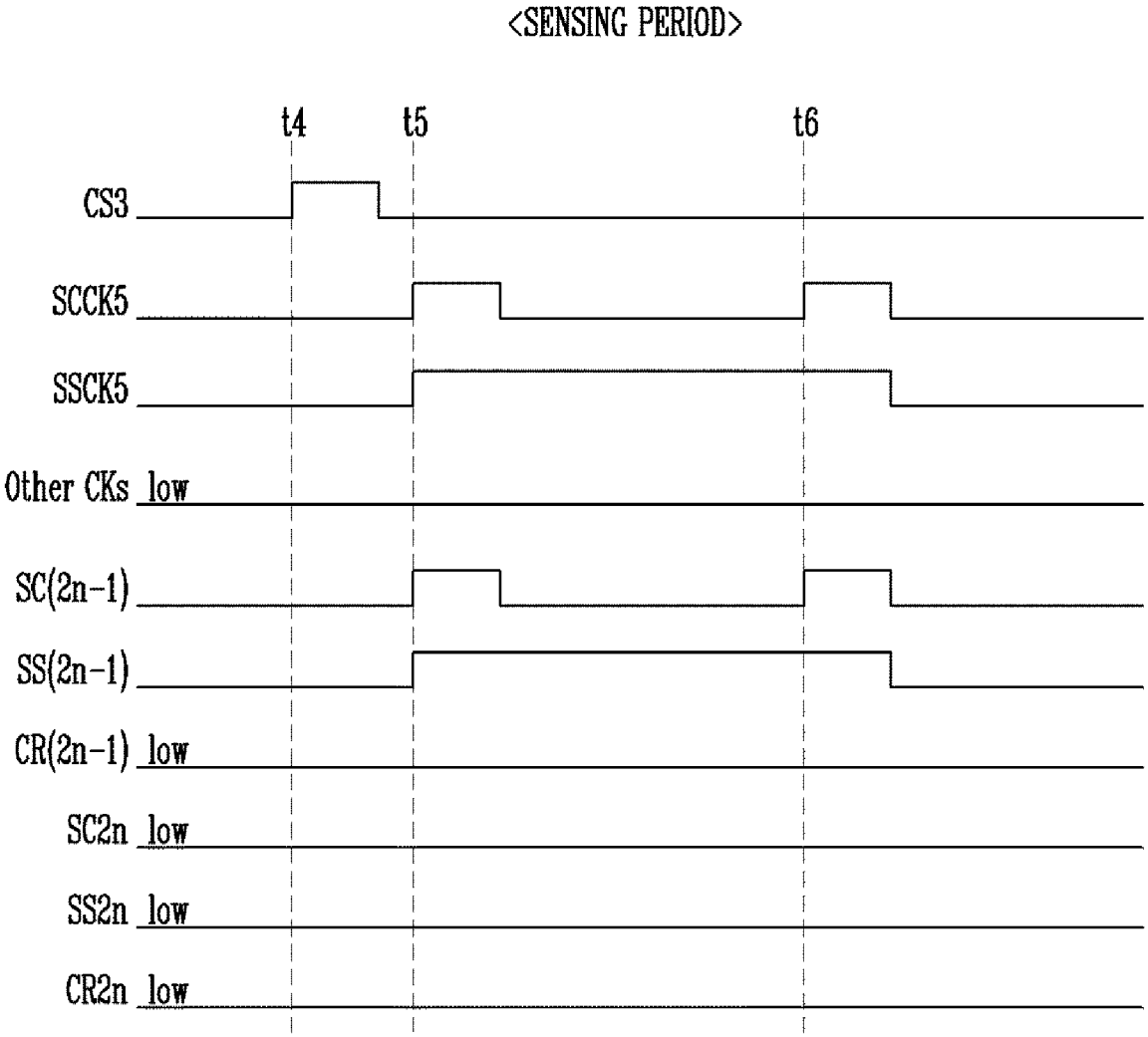
FIG. 7 is an exemplary timing diagram illustrating an example of an operation in a sensing period of the first scan stage and the second scan stage shown in FIG. 3.

An operation of the scan driver 13 related to the display period is shown in FIG. 4, and an operation in a sensing period is shown in FIG. 7 and will be separately described.

The sensor 14 may measure degradation information of pixels according to currents or voltages received through receiving lines R1, R2, R3, . . . , and Rq. For example, the degradation information of pixels may be mobility information of driving transistors, threshold voltage information of the driving transistors, degradation information of light emitting devices, etc. Also, the sensor 14 may measure characteristic information of pixels, which may be changed depending on the environment, according to the currents or voltages received through the receiving lines R1 to Rq. For example, the sensor 14 may measure characteristic information of pixels, which is changed depending on temperature or humidity.

The pixel unit 15 includes pixels. Each pixel PXij may be connected to a corresponding data line, a corresponding scan line, a corresponding sensing line, and a corresponding receiving line. Here, i and j may be integers greater than 0. For example, the pixel PXij may mean a pixel circuit including a scan transistor connected to an ith scan line and a jth data line.

Figure 2:
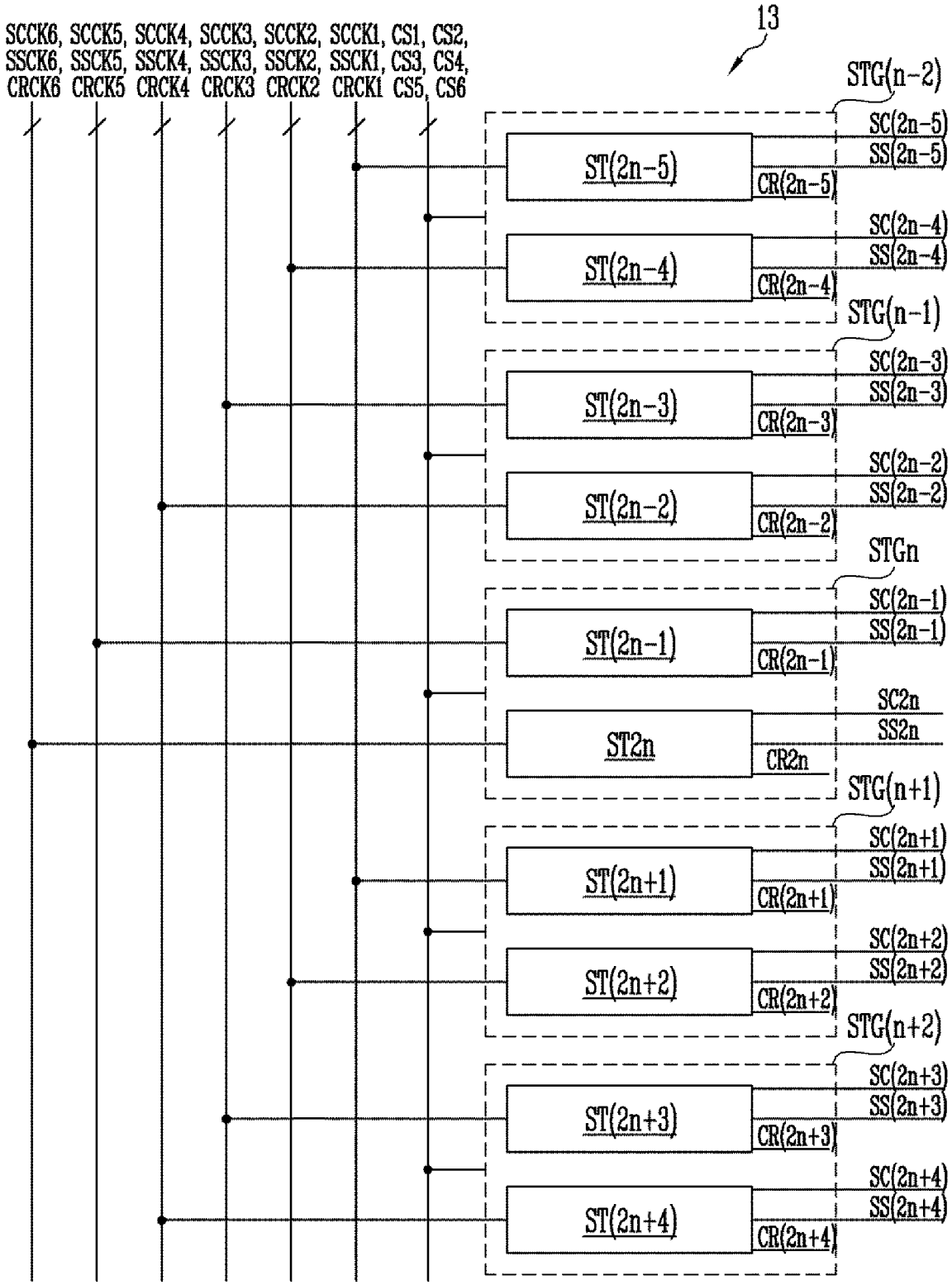
FIG. 2 is a block diagram of an exemplary embodiment of a scan driver constructed according to the principles of the invention.

FIG. 2 is a block diagram of an exemplary embodiment of a scan driver constructed according to the principles of the invention.

Referring to FIG. 2, the scan driver 13 may include a plurality of stage groups STG(n−2), STG(n−1), STGn, STG(n+1), and STG(n+2). In FIG. 2, only a portion of the scan driver 13, which is necessary for description, is illustrated.

Each of the stage groups STG(n−2), STG(n−1), STGn, STG(n+1), and STG(n+2) of the scan driver 13 may include a first stage and a second stage. In an example, the first stage may be an odd-numbered stage, and the second stage may be an even-numbered stage. In another example, the first stage may be an even-numbered stage, and the second stage may be an odd-numbered stage. For example, a $(n-2)^{th}$ stage group STG(n−2) may include a first stage ST(2n−5) and a second stage ST(2n−4), a $(n-1)^{th}$ stage group STG(n−1) may include a first stage ST(2n−3) and a second stage ST(2n−2), a $n^{th}$ stage group STGn may include a first stage ST(2n−1) and a second stage ST2*n*, a $(n+1)^{th}$ stage group STG(n+1) may include a first stage ST(2n+1) and a second stage ST(2n+2), and a $(n+1)^{th}$ stage group STG(n+2) may include a first stage ST(2n+3) and a second stage ST(2n+4). Here, n may be an integer greater than 0.

Each of the stages ST(2n−5) to ST(2n+4) may be connected to first to sixth control lines CS1, CS2, CS3, CS4, CS5, and CS6. Common control signals may be applied to the stages ST(2n−5) to ST(2n+4) through the first to sixth control lines CS1, CS2, CS3, CS4, CS5, and CS6.

Each of the stages ST(2n−5) to ST(2n+4) may be connected to corresponding input clock lines among scan clock lines SCCK1, SCCK2, SCCK3, SCCK4, SCCK5, and SCCK6, sensing clock lines SSCK1, SSCK2, SSCK3, SSCK4, SSCK5, and SSCK6, and carry clock lines CRCK1, CRCK2, CRCK3, CRCK4, CRCK5, and CRCK6.

For example, the first stage ST(2n−5) of the $(n-2)^{th}$ stage group STG(n−2) may be connected to a scan clock line SCCK1, a sensing clock line SSCK1, and a carry clock line CRCK1, and the second stage ST(2n−4) of the $(n-2)^{th}$ stage group STG(n−2) may be connected to a scan clock line SCCK, a sensing clock line SSCK2, and a carry block line CRCK2. The first stage ST(2n−3) of the $(n-1)^{th}$ stage group STG(n−1) may be connected to a scan clock line SCCK3, a sensing clock line SSCK3, and a carry clock line CRCK3, and the second stage ST(2n−2) of the $(n-1)^{th}$ stage group STG(n−1) may be connected to a scan clock line SCCK4, a sensing clock line SSCK4, and a carry clock line CRCK4. The first stage ST(2n−1) of the $n^{th}$ stage group STGn may be connected to a scan clock line SCCK5, a sensing clock line SSCK5, and a carry clock line CRCK5, and the second stage ST2*n* of the $n^{th}$ stage group STGn may be connected to a scan clock line SCCK6, a sensing clock line SSCK6, and a carry clock line CRCK6.

In addition, iteratively, the first stage ST(2n+1) of the $(n+1)^{th}$ stage group STG(n+1) may be connected to the scan clock line SCCK1, a sensing clock line SSCK1, and a carry clock line CRCK1, and the second stage ST(2n+2) of the $(n+1)^{th}$ stage group STG(n+1) may be connected to the scan clock line SCCK2, the sensing clock line SSCK2, and the carry clock line CRCK2. The first stage ST(2n+3) of the $(n+2)^{th}$ stage group STG(n+2) may be connected to the scan clock line SCCK3, the sensing clock line SSCK3, and the carry clock line CRCK3, and the second stage ST(2n+4) of the $(n+2)^{th}$ stage group STG(n+2) may be connected to the scan clock line SCCK4, the sensing clock line SSCK4, and the carry clock line CRCK4.

Input signals for the respective scan stages ST(2n−5) to ST(2n+4) are applied to the first to sixth control lines CS1 to CS6, the scan clock lines SCCK1 to SCCK6, the sensing clock lines SSCK1 to SSCK6, and the carry clock lines CRCK1 to CRCK6.

Each of the scan stages ST(2n−5) to ST(2n+4) may be connected to corresponding output lines among scan lines SC(2n−5) to SC(2n+4), sensing lines SS(2n−5) to SS(2n+4), and carry lines CR(2n−5) to CR(2n+4).

For example, the first stage ST(2n−5) of the $(n-2)^{th}$ stage group STG(n−2) may be connected to a scan line SC(2n−5), a sensing line SS(2n−5), and carry line CR(2n−5), the second stage ST(2n−4) of the $(n-2)^{th}$ stage group STG(n−2) may be connected to a scan line SC(2n−4), a sensing line SS(2n−4), and a carry line CR(2n−4). The first stage ST(2n−3) of the $(n-1)^{th}$ stage group STG(n−1) may be connected to a scan line SC(2n−3), a sensing line SS(2n−3), and a carry line CR(2n−3), and the second stage ST(2n−2) of the $(n-1)^{th}$ stage group STG(n−1) may be connected to a scan line SC(2n−2), a sensing line SS(2n−2), and a carry line CR(2n−2).

Output signals generated by the respective scan stages ST(2n−5) to ST(2n+4) are outputted through the scan lines SC(2n−5) to SC(2n+4), the sensing lines SS(2n−5) to SS(2n+4), and the carry lines CR(2n−5) to CR(2n+4).

Figure 3:
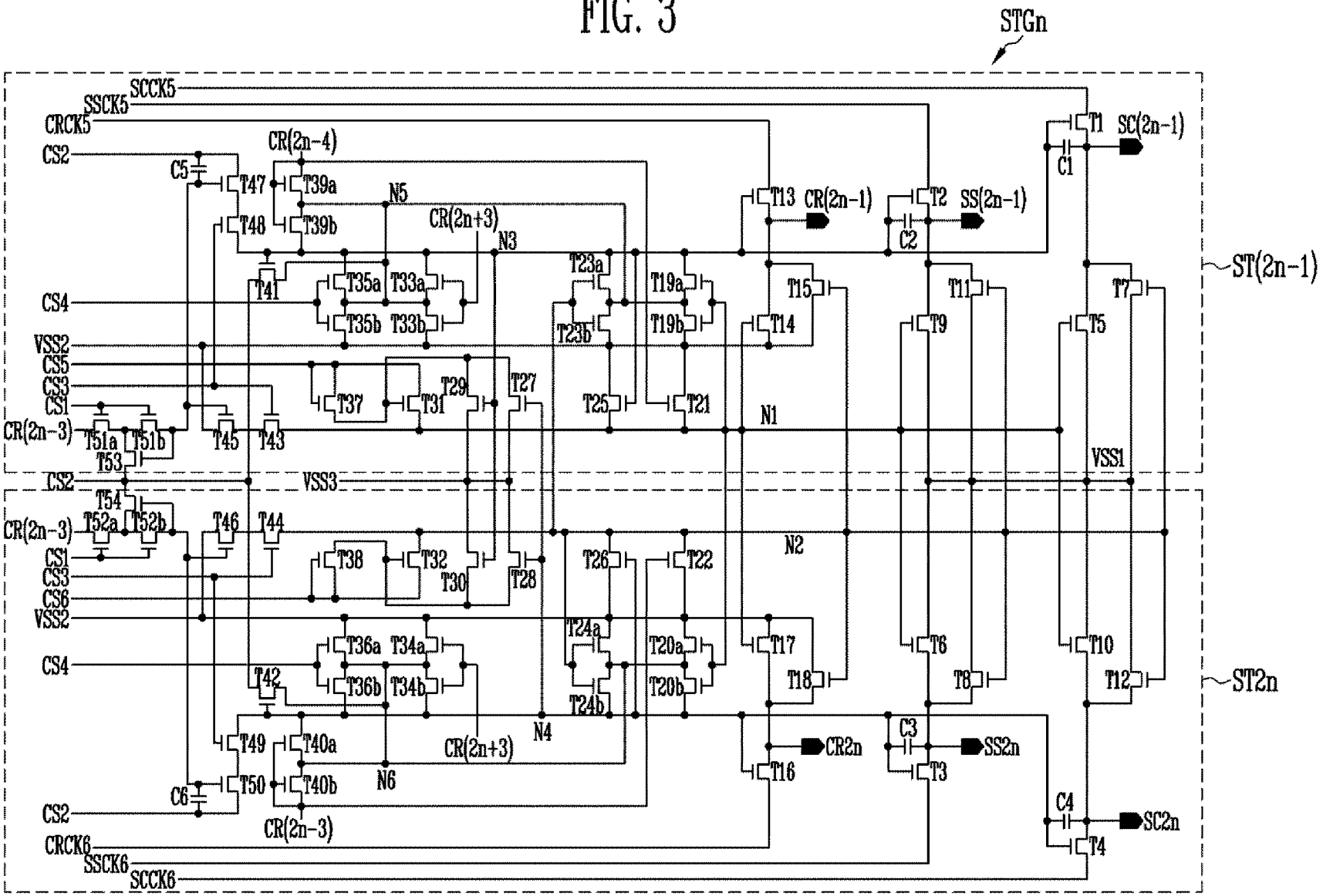
FIG. 3 is a circuit diagram of an exemplary embodiment of a stage group of the scan driver shown in FIG. 2.

FIG. 3 is a circuit diagram of an exemplary embodiment of a stage group of the scan driver shown in FIG. 2.

Referring to FIG. 3, the $n^{th}$ stage group STGn including the first stage ST(2n−1) and the second stage ST2*n* is exemplarily illustrated. The other stage groups shown in FIG. 2 may be configured substantially identically to the stage group STGn shown in FIG. 3, and therefore, repetitive descriptions will be omitted to avoid redundancy.

In drawings from FIG. 3, a case where transistors is implemented with an N-type transistor (e.g., an NMOS transistor) is assumed and described, but those skilled in the art may implement the stage group STGn by replacing some or all of the transistors with a P-type transistor (e.g., a PMOS transistor).

A first electrode of a first transistor T1 may be connected to a scan line SC(2n−1), a second electrode of the first transistor T1 may be connected to a scan clock line SCCK5, and a gate electrode of the first transistor T1 may be connected to a third node N3.

A first electrode of a second transistor T2 may be connected to a sensing line SS(2n−1), a second electrode of the second transistor T2 may be connected to a sensing clock line SSCK5, and a gate electrode of the second transistor T2 may be connected to the third node N3. A first electrode of a third transistor T3 may be connected to a sensing line SS2*n*, a second electrode of the third transistor T3 may be connected to a sensing clock line SSCK6, and a gate electrode of the third transistor T3 may be connected to a fourth node N4.

A first electrode of a fourth transistor T4 may be connected to a scan line SC2*n*, a second electrode of the fourth transistor T4 may be connected to a scan clock line SCCK6, and a gate electrode of the fourth transistor T4 may be connected to a fourth node N4.

A first electrode of a fifth transistor T5 may be connected to a first power line VSS1, a second electrode of the fifth transistor T5 may be connected to the first electrode of the first transistor T1, and a gate electrode of the fifth transistor T5 may be connected to a first node N1.

A first electrode of a sixth transistor T6 may be connected to the first power line VSS1, a second electrode of the sixth transistor T6 may be connected to the first electrode of the third transistor T3, and a gate electrode of the sixth transistor T6 may be connected to the first node N1.

A first electrode of a seventh transistor T7 may be connected to the first power line VSS1, a second electrode of the seventh transistor T7 may be connected to the first transistor T1, and a gate electrode of the seventh transistor T7 may be connected to a second node N2.

A first electrode of an eighth transistor T8 may be connected to the first power line VSS1, a second electrode of the eighth transistor T8 may be connected to the first electrode of the third transistor T3, and a gate electrode of the eighth transistor T8 may be connected to the second node N2.

A first electrode of a ninth transistor T9 may be connected to the first power line VSS1, a second electrode of the ninth transistor T9 may be connected to the first electrode of the second transistor T2, and a gate electrode of the ninth transistor T9 may be connected to the first node N1.

A first electrode of a tenth transistor T10 may be connected to the first power line VSS1, a second electrode of the tenth transistor T10 may be connected to the first electrode of the fourth transistor T4, and a gate electrode of the tenth transistor T10 may be connected to the first node N1.

A first electrode of an eleventh transistor T11 may be connected to the first power line VSS1, a second electrode of the eleventh transistor T11 may be connected to the first electrode of the second transistor T2, and a gate electrode of the eleventh transistor T11 may be connected to the second node N2.

A first electrode of a twelfth transistor T12 may be connected to the first power line VSS1, a second electrode of the twelfth transistor T12 may be connected to the first electrode of the fourth transistor T4, and a gate electrode of the twelfth transistor T12 may be connected to the second node N2.

A first electrode of a thirteenth transistor T13 may be connected to a carry line CR(2n−1), a second electrode of the thirteenth transistor T13 may be connected to a carry clock line CRCK5, and a gate electrode of the thirteenth transistor T13 may be connected to the third node N3.

A first electrode of a fourteenth transistor T14 may be connected to a second power line VSS2, a second electrode of the fourteenth transistor T14 may be connected to the first electrode of the thirteenth transistor T13, and a gate electrode of the fourteenth transistor T14 may be connected to first node N1.

A first electrode of a fifteenth transistor T15 may be connected to the second power line VSS2, a second electrode of the fifteenth transistor T15 may be connected to the first electrode of the thirteenth transistor T13, and a gate electrode of the fifteenth transistor T15 may be connected to the second node N2.

A first electrode of a sixteenth transistor T16 may be connected to a carry line CR2*n*, a second electrode of the sixteenth transistor T16 may be connected to a carry clock line CRCK6, and a gate electrode of the sixteenth transistor T16 may be connected to the fourth node N4.

A first electrode of a seventeenth transistor T17 may be connected to the second power line VSS2, a second electrode of the seventeenth transistor T17 may be connected to the first electrode of the sixteenth transistor T16, and a gate electrode of the seventeenth transistor T17 may be connected to the first node N1.

A first electrode of an eighteenth transistor T18 may be connected to the second power line VSS2, a second electrode of the eighteenth transistor T18 may be connected to the first electrode of the sixteenth transistor T16, and a gate electrode of the eighteenth transistor T18 may be connected to the second node N2.

A first electrode of a nineteenth transistor T19 may be connected to the second power line VSS2, a second electrode of the nineteenth transistor T19 may be connected to the third node N3, and a gate electrode of the nineteenth transistor T19 may be connected to the first node N1. In some exemplary embodiments, the nineteenth transistor T19 may include two sub-transistors T19*a* and T19*b* connected in series. An appropriate intermediate voltage is applied to a fifth node N5, so that the nineteenth transistor can reduce or prevent degradation due to an excessive voltage difference between a drain electrode and a source electrode.

A first electrode of a twentieth transistor may be connected to the second power line VSS2, a second electrode of the twentieth transistor may be connected to the fourth node N4, and a gate electrode of the twentieth transistor may be connected to the first node N1. In some exemplary embodiments, the twentieth transistor may include two sub-transistors T20*a* and T20*b* connected in series. An appropriate intermediate voltage is applied to a sixth node N6, so that the twentieth transistor can reduce or prevent degradation due to an excessive voltage difference between a drain electrode and a source electrode.

A first electrode of a twenty-first transistor T21 may be connected to the first node N1, a second electrode of the twenty-first transistor T21 may be connected to the second power line VSS2, and a gate electrode of the twenty-first transistor T21 may be connected to a carry line CR(2n−4). In some exemplary embodiments, the gate electrode of the twenty-first transistor T21 may be connected to another carry line.

A first electrode of a twenty-second transistor T22 may be connected to the second node N2, a second electrode of the twenty-second transistor T22 may be connected to the second power line VSS2, and a gate electrode of the twenty-second transistor T22 may be connected to a carry line CR(2n−3). In some exemplary embodiments, the gate electrode of the twenty-second transistor T22 may be connected to another carry line.

A first electrode of a twenty-third transistor may be connected to the second power line VSS2, a second electrode of the twenty-third transistor may be connected to the third node N3, and a gate electrode of the twenty-third transistor may be connected to the second node N2. In some exemplary embodiments, the twenty-third transistor may include two sub-transistors T23*a* and T23*b* connected in series. An appropriate intermediate voltage is applied to the fifth node N5, so that the twenty-third transistor can reduce or prevent degradation due to an excessive voltage difference between a drain electrode and a source electrode.

A first electrode of a twenty-fourth transistor may be connected to the second power line VSS2, a second electrode of the twenty-fourth transistor may be connected to the fourth node N4, and a gate electrode of the twenty-fourth transistor may be connected to the second node N2. In some exemplary embodiments, the twenty-fourth transistor may include two sub-transistors T24*a* and T24*b* connected in series. An appropriate intermediate voltage is applied to the sixth node N6, so that the twenty-fourth transistor can reduce or prevent degradation due to an excessive voltage difference between a drain electrode and a source electrode.

A first electrode of a twenty-fifth transistor T25 may be connected to the first node N1, a second electrode of the twenty-fifth transistor T25 may be connected to the second power line VSS2, and a gate electrode of the twenty-fifth transistor T25 may be connected to the third node N3.

A first electrode of a twenty-sixth transistor T26 may be connected to the second node N2, a second electrode of the twenty-sixth transistor T26 may be connected to the second power line VSS2, and a gate electrode of the twenty-sixth transistor T26 may be connected to the fourth node N4.

A first electrode of a twenty-seventh transistor T27 may be connected to a third power line VSS3, a second electrode of the twenty-seventh transistor T27 may be connected to a gate electrode of a thirty-first transistor T31, and a gate electrode of the twenty-seventh transistor T27 may be connected to the fourth node N4.

A first electrode of a twenty-eighth transistor T28 may be connected to the third power line VSS3, a second electrode of the twenty-eighth transistor T28 may be connected to a gate electrode of a thirty-second transistor T32, and a gate electrode of the twenty-eighth transistor T28 may be connected to the fourth node N4.

A first electrode of a twenty-ninth transistor T29 may be connected to the third power line VSS3, a second electrode of the twenty-ninth transistor T29 may be connected to the gate electrode of the thirty-first transistor T31, and a gate electrode of the twenty-ninth transistor T29 may be connected to the third node N3.

A first electrode of a thirtieth transistor T30 may be connected to the third power line VSS3, a second electrode of the thirtieth transistor T30 may be connected to the gate electrode of the thirty-second transistor T32, and a gate electrode of the thirtieth transistor T30 may be connected to the third node N3.

A first electrode of the thirty-first transistor T31 may be connected to the first node, a second electrode of the thirty-first transistor T31 may be connected to a fifth control line CS5, and the thirty-first transistor T31 may include the gate electrode.

A first electrode of the thirty-second transistor T32 may be connected to the second node N2, a second electrode of the thirty-second transistor T32 may be connected to a sixth control line CS6, and the thirty-second transistor T32 may include the gate electrode.

A first electrode of a thirty-third transistor may be connected to the second power line VSS2, a second electrode of the thirty-third transistor may be connected to the third node N3, and a gate electrode of the thirty-third transistor may be connected to a carry line CR(2n+3). In some exemplary embodiments, the thirty-third transistor may include two sub-transistors T33*a* and T33*b* connected in series. An appropriate intermediate voltage is applied to the fifth node N5, so that the thirty-third transistor can reduce or prevent degradation due to an excessive voltage difference between a drain electrode and a source electrode. In some embodiments, the gate electrode of the thirty-third transistor may be connected to another carry line.

A first electrode of a thirty-fourth transistor may be connected to the second power line VSS2, a second electrode of the thirty-fourth transistor may be connected to the fourth node N4, and a gate electrode of the thirty-fourth transistor may be connected to the carry line CR(2n+3). In some exemplary embodiments, the thirty-fourth transistor may include two sub-transistors T34*a* and T34*b* connected in series. An appropriate intermediate voltage is applied to the sixth node N6, so that the thirty-fourth transistor can reduce or prevent degradation due to an excessive voltage difference between a drain electrode and a source electrode. In some embodiments, the gate electrode of the thirty-fourth transistor may be connected to another carry line.

A first electrode of a thirty-fifth transistor may be connected to the second power line VSS2, a second electrode of the thirty-fifth transistor may be connected to the third node N3, and a gate electrode of the thirty-fifth transistor may be connected to a fourth control line CS4. In some exemplary embodiments, the thirty-fifth transistor may include two sub-transistors T35*a* and T35*b* connected in series. An appropriate intermediate voltage is applied to the fifth node N5, so that the thirty-fifth transistor can reduce or prevent degradation due to an excessive voltage difference between a drain electrode and a source electrode.

A first electrode of a thirty-sixth transistor may be connected to the second power line VSS2, a second electrode of the thirty-sixth transistor may be connected to the fourth node N2, and a gate electrode of the thirty-sixth transistor may be connected to the fourth control line CS4. In some exemplary embodiments, the thirty-sixth transistor may include two sub-transistors T36*a* and T36*b* connected in series. An appropriate intermediate voltage is applied to the sixth node N6, so that the thirty-sixth transistor can reduce or prevent degradation due to an excessive voltage difference between a drain electrode and a source electrode.

A first electrode of a thirty-seventh transistor T37 may be connected to the gate electrode of the thirty-first transistor T31, and a second electrode and a gate electrode of the thirty-seventh transistor T37 may be connected to the fifth control line CS5.

A first electrode of a thirty-eighth transistor T38 may be connected to the gate electrode of the thirty-second transistor T32, and a second electrode and a gate electrode of the thirty-eighth transistor T38 may be connected to the sixth control line CS6.

A first electrode of a thirty-ninth transistor may be connected to the third node N3, and a second electrode and a gate electrode of the thirty-ninth transistor may be connected to the carry line CR(2n−4). In some exemplary embodiments, the thirty-ninth transistor may include two sub-transistors T39*a* and T39*b* connected in series. An appropriate intermediate voltage is applied to the fifth node N5, so that the thirty-ninth transistor can reduce or prevent degradation due to an excessive voltage difference between a drain electrode and a source electrode. In some embodiments, the gate electrode of the thirty-ninth transistor may be connected to another carry line.

A first electrode of a fortieth transistor may be connected to the fourth node N4, and a second electrode and a gate electrode of the fortieth transistor may be connected to the carry line CR(2n−3). In some exemplary embodiments, the fortieth transistor may include two sub-transistors T40*a* and T40*b* connected in series. An appropriate intermediate voltage is applied to the sixth node N6, so that the fortieth transistor can reduce or prevent degradation due to an excessive voltage difference between a drain electrode and a source electrode. In some embodiments, the gate electrode of the fortieth transistor may be connected to another carry line.

A first electrode of a forty-first transistor T41 may be connected to the fifth node N5, a second electrode of the forty-first transistor T41 may be connected to a second control line CS2, and a gate electrode of the forty-first transistor T41 may be connected to the third node N3.

A first electrode of a forty-second transistor T42 may be connected to the sixth node N6, a second electrode of the forty-second transistor T42 may be connected to the second control line CS2, and a gate electrode of the forty-second transistor T42 may be connected to the fourth node N4.

A first electrode of a forty-third transistor T43 may be connected to the first node, a second electrode of the forty-third transistor T43 may be connected to a first electrode of a forty-fifth transistor T45, and a gate electrode of the forty-third transistor T43 may be connected to a third control line CS3.

A first electrode of a forty-fourth transistor T44 may be connected to the second node N2, a second electrode of the forty-fourth transistor T44 may be connected to a first electrode of a forty-sixth transistor T46, and a gate electrode of the forty-fourth transistor T44 may be connected to the third control line CS3.

The first electrode of the forty-fifth transistor T45 may be connected to the second electrode of the forty-third transistor T43, a second electrode of the forty-fifth transistor T45 may be connected to the second power line VSS2, and a gate electrode of the forty-fifth transistor T45 may be connected to a first electrode of a fifty-first transistor.

The first electrode of the forty-sixth transistor T46 may be connected to the second electrode of the forty-fourth transistor T44, a second electrode of the forty-sixth transistor T46 may be connected to the second power line VSS2, and a gate electrode of the forty-sixth transistor T46 may be connected to a first electrode of a fifty-second transistor.

A first electrode of a forty-seventh transistor T47 may be connected to a second electrode of a forty-eighth transistor 48, a second electrode of the forty-seventh transistor T47 may be connected to the second control line CS2, and a gate electrode of the forty-seventh transistor T47 may be connected to the first electrode of fifty-first transistor.

A first electrode of the forty-eighth transistor T48 may be connected to the third node N3, the second electrode of the forty-eighth transistor T48 may be connected to the first electrode of the forty-seventh transistor T47, and a gate electrode of the forty-eighth transistor T48 may be connected to the third control line CS3.

A first electrode of a forty-ninth transistor T49 may be connected to the fourth node N4, a second electrode of the forty-ninth transistor T49 may be connected to a first electrode of a fiftieth transistor T50, and a gate electrode of the forty-ninth transistor T49 may be connected to the third control line CS3.

The first electrode of the fiftieth transistor T50 may be connected to the second electrode of the forty-ninth transistor T49, a second electrode of the fiftieth transistor T50 may be connected to the second control line CS2, and a gate electrode of the fiftieth transistor T50 may be connected to the first electrode of the fifty-second transistor.

The fifty-first transistor may include the first electrode, a second electrode of the fifty-first transistor may be connected to the carry line CR(2n−3), and a gate electrode of the fifty-first transistor may be connected to a first control line CS1. The fifty-first transistor may include two sub-transistors T51*a* and T51*b* connected in series. In some exemplary embodiments, the gate electrode of the fifty-first transistor may be connected to another carry line.

The fifty-second transistor may include the first electrode, a second electrode of the fifty-second transistor may be connected to the carry line CR(2n−3), and a gate electrode of the fifty-second transistor may be connected to the first control line CS1. The fifty-second transistor may include two sub-transistors T52*a* and T52*b* connected in series. In some exemplary embodiments, the gate electrode of the fifty-second transistor may be connected to another carry line.

A first electrode of a fifty-third transistor T53 may be connected to the second control line CS2, a second electrode of the fifty-third transistor T53 may be connected to a second electrode of the sub-transistor T51*b*, and a gate electrode of the fifty-third transistor T53 may be connected to a first electrode of the sub-transistor T51*b*.

A first electrode of a fifty-fourth transistor T54 may be connected to the second control line CS2, a second electrode of the fifty-fourth transistor T54 may be connected to a second electrode of the sub-transistor T52*b*, and a gate electrode of the fifty-fourth transistor T54 may be connected to a first electrode of the sub-transistor T52*b*.

A first electrode of a first capacitor C1 may be connected to the first electrode of the first transistor T1, and a second electrode of the first capacitor C1 may be connected to the gate electrode of the first transistor T1.

A first electrode of a second capacitor C2 may be connected to the first electrode of the second transistor T2, and a second electrode of the second capacitor C2 may be connected to the gate electrode of the second transistor T2.

A first electrode of a third capacitor C3 may be connected to the first electrode of the third transistor T3, and a second electrode of the third capacitor C3 may be connected to the gate electrode of the third transistor T3.

A first electrode of a fourth capacitor C4 may be connected to the first electrode of the fourth transistor T4, and a second electrode of the fourth capacitor C4 may be connected to the gate electrode of the fourth transistor T4.

A first electrode of a fifth capacitor C5 may be connected to the gate electrode of the forty-seventh transistor T47, and a second electrode of the fifth capacitor C5 may be connected to the second electrode of the forty-seventh transistor T47.

A first electrode of a sixth capacitor C6 may be connected to the gate electrode of the fiftieth transistor T50, and a second electrode of the sixth capacitor C6 may be connected to the second electrode of the fiftieth transistor T50.

Figure 5:
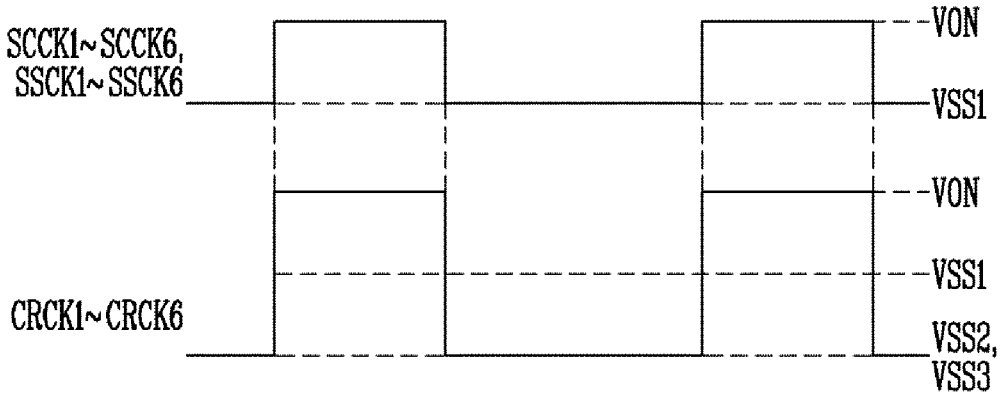
FIG. 5 is a diagram illustrating an example of voltage levels of the clock signals shown in FIG. 4.

FIGS. 4 and 5 are diagrams illustrating an exemplary driving method of the scan driver shown in FIG. 3 in the display period. To be specific, FIG. 4 is an exemplary timing diagram illustrating an example of an operation in the display period of the first scan stage and the second scan stage shown in FIG. 3, and FIG. 5 is a diagram illustrating an example of voltage levels of the clock signals shown in FIG. 4.

Referring to FIG. 4, signals are illustrated, which are applied to the first control line CS1, the fourth control line CS4, the scan clock lines SCCK1 to SCCK6, the sensing clock lines SSCK1 to SSCK6, the carry clock lines CRCK1 to CRCK6, the first scan carry line CR(n−3), the first sensing carry line CR(n−2), the first scan line SCn, the second scan line SC(n+1), the first sensing line SSn, the second sensing line SS(n+1), the first carry line CRn, and the second carry line CR(n+1).

In the display period, a scan clock signal, a sensing clock signal, and a carry clock signal, which are respectively applied to a scan clock line, a sensing clock line, and a carry clock line, which are connected to the same scan stage, may have the same phase. Therefore, in FIG. 4, a signal of the first clock lines SCCK1, SSCK1, and CRCK1 is commonly illustrated, a signal of the second clock lines SCCK2, SSCK2, and CRCK2 is commonly illustrated, a signal of the third clock lines SCCK3, SSCK3, and CRCK3 is commonly illustrated, a signal of the fourth clock lines SCCK4, SSCK4, and CRCK4 is commonly illustrated, a signal of the fifth clock lines SCCK5, SSCK5, and CRCK5 is commonly illustrated, and a signal of the sixth clock lines SCCK6, SSCK6, and CRCK6 is commonly illustrated.

However, referring to FIG. 5, the scan clock signal, the sensing clock signal, and the carry clock signal, which are respectively applied to the scan clock line, the sensing clock line, and the carry clock line, which are connected to the same scan stage, may have different magnitudes. For example, a low level of the scan clock signals and the sensing clock signals may correspond to the magnitude of a voltage applied to the first power line VSS1, and a high level of the scan clock signals and the sensing clock signals may correspond to the magnitude of a gate-on voltage VON. In addition, a low level of the carry clock signals may correspond to the magnitude of a voltage applied to the second power line VSS2 or the third power line VSS3, and a high level of the carry clock signals may correspond to the magnitude of the gate-on voltage VON. For example, the voltage applied to the first power line VSS1 may be higher than that applied to the second power line VSS2 or the third power line VSS3.

The magnitude of the gate-on voltage VON may be large enough to turn on the transistors, and the magnitude of each of the voltages applied to the first, second, and third power lines VSS1, VSS2, and VSS3 may be sufficient enough to turn off the transistors. Hereinafter, a voltage level corresponding to the magnitude of the gate-on voltage VON may be expressed as the high level, and a voltage level corresponding to the magnitude of each of the voltages applied to the first, second, and third power lines VSS1, VSS2, and VSS3 may be expressed as the low level.

Referring back to FIG. 4, high-level pulses of the second clock lines SCCK2, SSCK2, and CRCK2 have a phase delayed from those of the first clock lines SCCK1, SSCK1, and CRCK1, and the high-level pulses of the clock lines SCCK2, SSCK2, and CRCK2 and the high-level pulses of the first clock lines SCCK1, SSCK1, and CRCK1 may temporally and partially overlap with each other. For example, the high-level pulses may have a length of two horizontal periods, and the overlapping length may correspond to one horizontal period.

Similarly, high-level pulses of the third clock lines SCCK3, SSCK3, and CRCK3 have a phase delayed from those of the second clock lines SCCK2, SSCK2, and CRCK2, and the high-level pulses of the third clock lines SCCK3, SSCK3, and CRCK3 and the high-level pulses of the second clock lines SCCK2, SSCK2, and CRCK2 may temporally and partially overlap with each other. High-level pulses of the fourth clock lines SCCK4, SSCK4, and CRCK4 have a phase delayed from those of the third clock lines SCCK3, SSCK3, and CRCK3, and the high-level pulses of the fourth clock lines SCCK4, SSCK4, and CRCK4 and the high-level pulses of the third clock lines SCCK3, SSCK3, and CRCK3 may temporally and partially overlap with each other. High-level pulses of the fifth clock lines SCCK5, SSCK5, and CRCK5 have a phase delayed from those of the fourth clock lines SCCK4, SSCK4, and CRCK4, and the high-level pulses of the fifth clock lines SCCK5, SSCK5, and CRCK5 and the high-level pulses of the fourth clock lines SCCK4, SSCK4, and CRCK4 may temporally and partially overlap with each other. High-level pulses of the sixth clock lines SCCK6, SSCK6, and CRCK6 have a phase delayed from those of the fifth clock lines SCCK5, SSCK5, and CRCK5, and the high-level pulses of the sixth clock lines SCCK6, SSCK6, and CRCK6 and the high-level pulses of the fifth clock lines SCCK5, SSCK5, and CRCK5 may temporally and partially overlap with each other. In addition, iteratively, the high-level pulses of the first clock lines SCCK1, SSCK1, and CRCK1 have a phase delayed from those of the sixth clock lines SCCK6, SSCK6, and CRCK6, and the high-level pulses of the first clock lines SCCK1, SSCK1, and CRCK1 and the high-level pulses of the sixth clock lines SCCK6, SSCK6, and CRCK6 may temporally and partially overlap with each other.

Hereinafter, an operation of the first stage ST(2n−1) in the display period will be described as referring to FIGS. 3, 4, and 5. Operations of the other stages are similar to that of the first stage ST(2n−1), and therefore, repetitive descriptions will be omitted to avoid redundancy.

First, a high-level pulse may be applied to the fourth control line CS4. Therefore, the thirty-fifth transistor may be turned on, and a voltage of the third node N3 may be discharged to the low level.

After a certain time elapses, at a first time point t1, a high-level pulse may be applied to the first carry line CR(2n−4). Accordingly, the thirty-ninth transistor is turned on, and the third node N3 is charged to the high level. The forty-first transistor T41 may be turned on, and the fifth node N5 may be charged to a high-level voltage applied to the second control line CS2.

Next, at a second time point t2, a high-level pulse is applied to the first control line CS1, and therefore, the fifty-first transistor may be turned on. Since a high-level pulse is generated in the carry line CR(2n−3), a high-level voltage may be charged in the first electrode of the fifth capacitor C5 through the fifty-first transistor.

Next, at a third time point t3, high-level pulses are applied to the fifth clock lines SCCK5, SSCK5, and CRCK5. Therefore, the voltage of the third node N3 may be boosted higher than the high level by the capacitors C1 and C2, and a high-level pulse may be output to the scan line SC(2n−1), the sensing line SS(2n−2), and the carry line CR(2n−1).

Since the high-level voltage is applied to the fifth node N5 in spite of the voltage boosting of the third node N3, voltage differences between the drain electrodes and the source electrodes of the transistors T19*a*, T19*b*, T23*a*, T23*b*, T33*a*, T33*b*, T35*a*, T35*b*, T39*a*, and T39*b* are not relatively large. Thus, degradation of the transistors T19*a*, T19*b*, T23*a*, T23*b*, T33*a*, T33*b*, T35*a*, T35*b*, T39*a*, and T39*b* can be minimized or prevented.

In a similar manner, when a high-level pulse is applied to the sixth clock lines SCCK6, SSCK6, and CRCK6, high-level pulses may be output from the scan line SC2*n*, the sensing line SS2*n*, and the carry line CR2*n* of the second stage ST2*n*.

Furthermore, in an exemplary embodiment, when a high-level pulse is applied through the carry line CR(2n+3), the third node N3 is connected to the second power line VSS2 through the thirty-third transistor, and therefore, the voltage of the third node N3 may be discharged to the low level.

Also, a high-level control signal may be alternately applied to the fifth control line CS5 and the sixth control line CS6 in a specific period unit. For example, the specific period unit may correspond to a period including several frames, and may include a first period and a second period next to the first period.

For example, during the first period, a high-level control signal may be applied to the fifth control lien CS5, and a low-level control signal may be applied to the sixth control line CS6. The transistors T31 and T37 may be turned on such that the first node N1 is charged to the high level. Therefore, the nineteenth transistor may be turned on to discharge the third node N3 to the low level, the fourteenth transistor T14 may be turned on to discharge the carry line CR(2n−1) to the low level, the ninth transistor T9 may be turned on to discharge the sensing line SS(2n−1) to the low level, and the fifth transistor T5 may be turned on to discharge the scan line SC(2n−1) to the low level.

During the second period next to the first period, a low-level control signal may be applied to the fifth control line CS5, and a high-level control signal may be applied to the sixth control line CS6. The transistors T32 and T38 may be turned on such that the second node N2 is charged to the high level. Therefore, the twenty-third transistor may be turned on to discharge the third node N3 to the low level, the fifteenth transistor T15 may be turned on to discharge the carry line CR(2n−2) to the low level, the eleventh transistor T11 may be turned on to discharge the sensing line SS(2n−1) to the low level, and the seventh transistor T7 may be turned on to discharge the scan line SC(2n−1) to the low level.

With respect to the first period and the second period, different transistors may be used for the discharge of the third node N3, the carry line CR(2n−1), the sensing line SS(2n−1), and the scan line SC(2n−1). Accordingly, a period in which an on-bias is applied to the corresponding transistors is shortened, so that degradation of the corresponding transistors which are included in the scan driver can be minimized or prevented.

Figure 6:
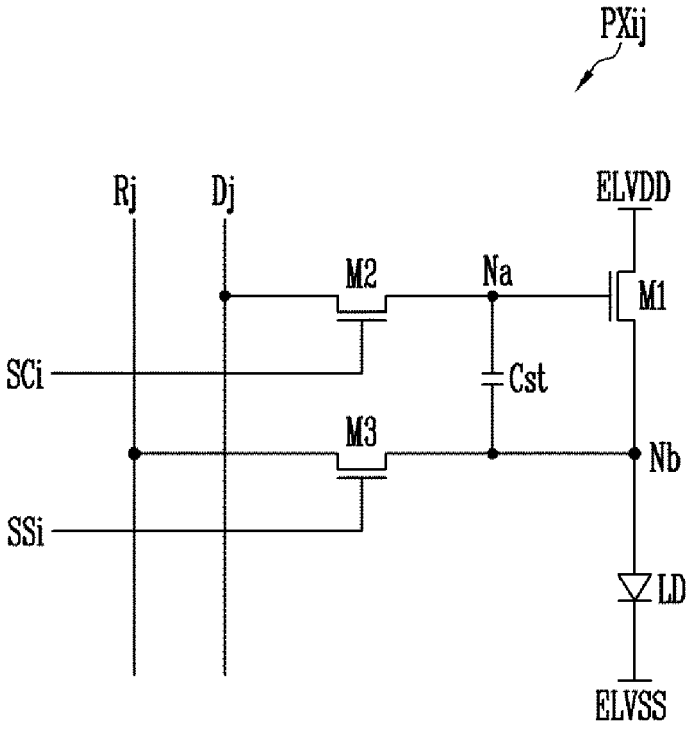
FIG. 6 is a circuit diagram illustrating an exemplary embodiment of a representative pixel of the display device of FIG. 1.

FIG. 6 is a circuit diagram illustrating exemplary embodiment of a representative pixel of the display device of FIG. 1.

Referring to FIG. 6, the pixel PXij may include pixel transistors M1, M2, and M3, a storage capacitor Cst, and a light emitting device LD. The pixel transistors M1, M2, and M3 are illustrated as N-type transistors. However, in some embodiments, at least some of the pixel transistors M1, M2, and M3 may be implemented with a P-type transistor.

A gate electrode of a first pixel transistor M1 may be connected to a node Na, a first electrode of the first pixel transistor M1 may be connected to a power line ELVDD, and a second electrode of the first pixel transistor M1 may be connected to a node Nb. The first pixel transistor M1 may be referred to as a driving transistor.

A gate electrode of a second pixel transistor M2 may be connected to a scan line SCi, a first electrode of the second pixel transistor M2 may be connected to a data line Dj, a second electrode of the second pixel transistor M2 may be connected to the node Na. The second pixel transistor M2 may be referred to as a switching transistor, a scan transistor, or the like.

A gate electrode of a third pixel transistor M3 may be connected to a sensing line SSi, a first electrode of the third pixel transistor M3 may be connected to a receiving line Rj, and a second electrode of the third pixel transistor M3 may be connected to the node Nb. The third pixel transistor M3 may be referred to as an initialization transistor, a sensing transistor, or the like.

A first electrode of the storage capacitor Cst may be connected to the node Na, and a second electrode of the storage capacitor Cst may be connected to the node Nb.

An anode of the light emitting device LD may be connected to the node Nb, and a cathode of the light emitting device LD may be connected to a power line ELVSS. The light emitting device LD may be configured as an organic light emitting diode, an inorganic light emitting diode, a quantum dot light emitting diode, or the like.

With reference to the description shown in FIG. 4, a high-level pulse may be applied to the scan line SCi and the sensing line SSi at least once during a display period of one frame. A corresponding data voltage may be applied to the data line Dj, and a first reference voltage may be applied to the receiving line Rj. Therefore, the storage capacitor Cst may store a voltage corresponding to the difference between the data voltage and the first reference voltage while the second and third pixel transistors M2 and M3 are in a turn-on state. Subsequently, although the second and third pixel transistors M2 and M3 are turned off, the voltage stored in the storage capacitor Cst may be maintained. The amount of driving current flowing through the first pixel transistor M1 is determined according to the voltage stored in the storage capacitor Cst, and the light emitting device LD emits light with a luminance corresponding to the amount of driving current.

FIG. 7 is an exemplary timing diagram illustrating an example of an operation in a sensing period of the first scan stage and the second scan stage shown in FIG. 3.

Referring to FIG. 7, signals are illustrated, which are applied to the third control line CS3, the fifth scan clock line SCCK5, the sensing clock line SSCK, other clock lines Other CKs, the scan lines SC(2n−1) and SC2*n*, the sensing lines SS(2n−1) and SS2*n*, and carry lines CR(2n−1) and CR2*n*.

At a fourth time point t4, a high-level pulse may be applied to the third control line CS3. Accordingly, the forty-eighth transistor T48 may be turned on. Since the fifth capacitor C5 is in a state in which a voltage is charged in the fifth capacitor C5 during the above-described during the second time point t2 to the third time point t3, the forty-seventh transistor T47 may be in the turn-on state. Accordingly, a high-level voltage applied to the second control line CS2 may be applied to the third node N3 through the transistors T47 and T48.

In the other first stages except the first stage ST(2n−1), the forty-seventh transistor T47 is in a turn-off state, and hence the third node N3 may maintain the low level.

Next, at a fifth time point t5, a high-level signal may be applied to the fifth scan clock line SCCK5 and the fifth sensing clock line SSCK5. Therefore, the voltage of the third node N3 may be boosted by the capacitors C1 and C2, and a high-level signal may be output to the scan line SC(2n−1) and the sensing line SS(2n−1).

Accordingly, the second and third pixel transistors M2 and M3 of pixels connected to the scan line SC(2n−1) and the sensing line SS(2n−1) may be turned on. A second reference voltage may be applied to the data lines. The sensor 14 may measure degradation information or characteristic information of pixels according to current values or voltage values received through the receiving lines R1, R2, R3, . . . , Rj, . . . , and Rq.

In the other first stages except the first stage ST(2n−1), since the voltage of the third node N3 has the low level, a low-level signal may be output to corresponding scan lines and corresponding sensing lines in spite of the high-level pulses applied to the scan clock line SCCK5 and the sensing clock line SSCK5.

Since the fifty-second transistor of the second stage ST2*n* is connected to the same carry line CR(2n−3) as the first stage ST(2n−1), the sixth capacitor C6 may be in a state in which the same voltage as the fifth capacitor C5 is charged in the sixth capacitor C6. However, a low-level voltage is maintained in the scan clock line SCCK6 and the sensing clock line SSCK6, which are connected to the second stage ST2*n*, during the sensing period, so that the voltage of the scan line SC2*n* and the sensing line SS2*n* can maintain the low level.

At a sixth time point t6, a high-level signal may be applied to the scan clock line SCCK5 and the sensing clock line SSCK5. Just previous data voltages may be again applied to the data lines. Therefore, pixels connected to the scan line SC(2n−1) and the sensing line SS(2n−1) may again emit lights with grayscales based on the just previous data voltages.

In accordance with this exemplary embodiment, the pixels connected to the scan line SC(2n−1) and the sensing line SS(2n−1) do not emit lights with the grayscales based on the data voltages during the fifth time point t5 to sixth time point t6, but may again emit lights with the grayscales based on the data voltages after the sixth time point t6. In addition, pixels connected to other scan lines and other sensing lines continuously emit lights with the grayscales based on the data voltages during the sensing period, and thus there is no problem created preventing a viewer from recognizing a frame image.

Figure 8:
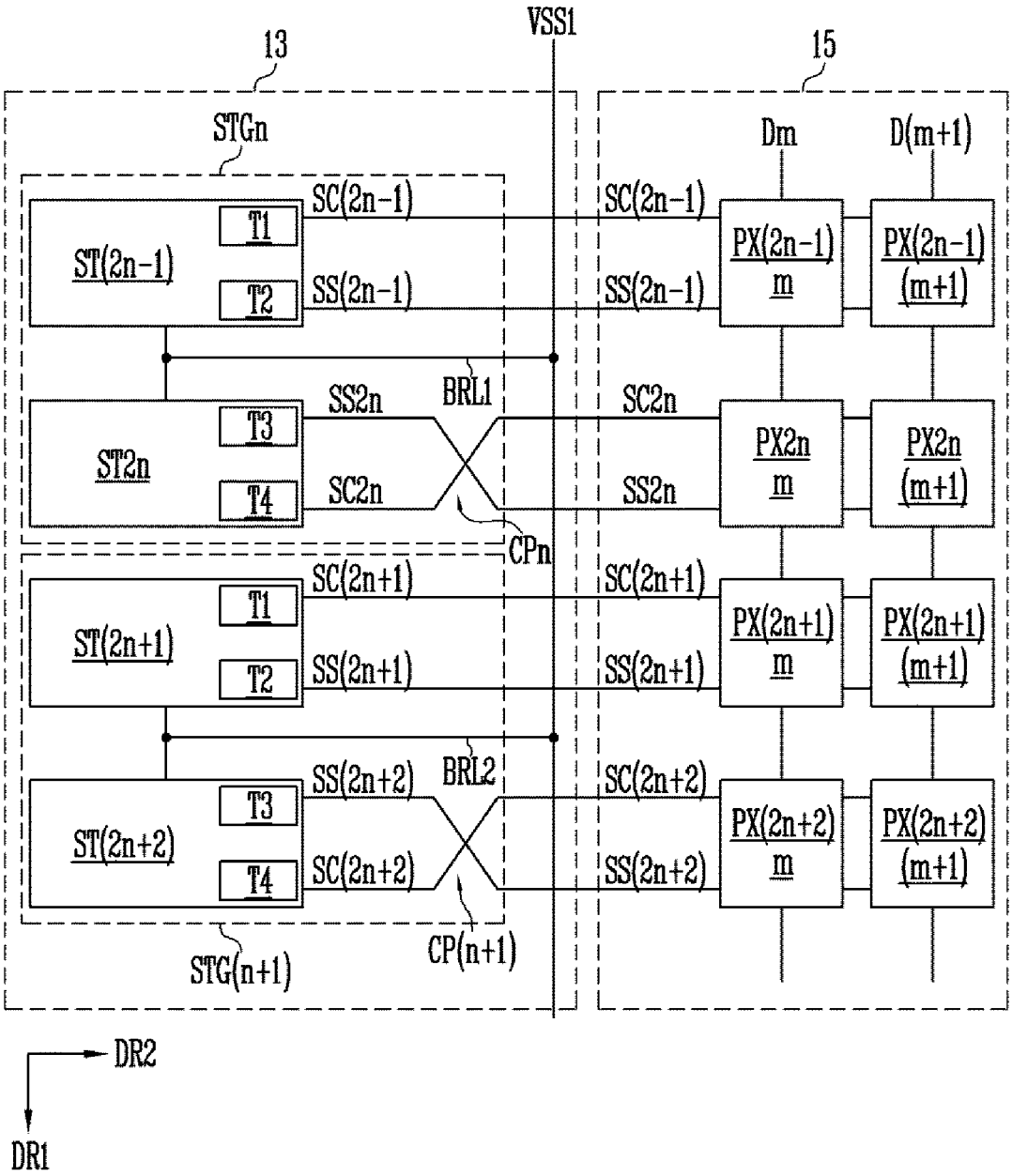
FIG. 8 is a diagram of an exemplary embodiment of a connection relationship between the scan driver and a pixel unit according to the principles of the invention.

FIG. 8 is a diagram of an exemplary embodiment of a connection relationship between the scan driver and a pixel unit according to the principles of the invention.

Referring to FIG. 8, an exemplary arrangement of components of the scan driver 13 and the pixel unit 15 is illustrated.

The scan driver 13 may include a plurality of stage groups including a first stage group STGn and a second stage group STG(n+1). The first stage group STGn may include a first stage ST(2n−1) and a second stage ST2*n* located in a first direction DR1 from the first stage ST(2n−1). For example, referring to FIG. 8, the first direction DR1 may be a Y direction from top to bottom, thereby the second stage ST2*n* may be located below from the first stage ST(2n−1) in the Y-axis. The second stage group STG(n+1) may be a most adjacent stage group located in the first direction DR1 from the stage group STGn. The second stage group STG(n+1) may also include a first stage ST(2n+1) and a second stage ST(2n+2) located in the first direction dR1 from the first stage ST(2n+1). In the same manner, referring to FIG. 8, the first direction DR1 may be a Y direction from top to bottom, thereby the second stage ST(2n+2) may be located below from the first stage ST(2n+1) in the Y-axis.

The scan driver 13 may include a first power line VSS1 extending in the first direction DR1, the first power line VSS1 being commonly connected to the plurality of stage groups STGn and STG(n+1). The first power line VSS1 may include a first branch line BRL1 extending in a second direction DR2 between the first stage ST(2n−1) and a second stage ST2*n* of the first stage group STGn. The second direction DR2 may be a direction different from the first direction DR1. For example, the second direction DR2 may be a direction orthogonal to the first direction DR1. The first branch line BRL1 may be connected to the first stage ST(2n−1) and the second stage ST2*n* of the first stage group STGn. Also, the first power line VSS1 may include a second branch line BRL2 extending in the second direction DR2 between the first stage ST(2n+1) and the second stage ST(2n+2) of the second stage group STG(n+1). The second branch line BRL2 may be connected to the first stage ST(2n+1) and the second stage ST(2n+2) of the second stage group STG(n+1).

As described above, a first stage ST(2n−1) and ST(2n+1) and a second stage ST2*n* and ST(2n+2) of each of the stage groups STGn and STG(n+1) share one branch line BRL1 and BRL2, respectively, so that the required area of the stage group STGn and STG(n+1) can be decreased. In addition, in order to share the branch line BRL1 and BRL2, the first stage ST(2n−1) and ST(2n+1) and the second stage ST2*n* and ST(2n+2) may have a layout in a mirror form in which they are symmetrical to each other with respect to the shared branch line BRL1 and BRL2. For example, the first stage ST(2n−1) and the second stage ST2*n* of the first stage group STGn may have a layout in which they are symmetrical to each other with respect to the first branch line BRL1. Also, the first stage ST(2n+1) and the second stage ST(2n+2) of the second stage group STG(n+1) may have a layout in which they are symmetrical to each other with respect to the second branch line BRL2.

For example, referring to FIG. 3, it can be seen that the first stage ST(2n−1) and the second stage ST2*n* may include transistors and capacitors, of which numbers are equal to each other, and positions and connection relationships of the respective transistors and capacitors are symmetrical to each other with respect to the first power line VSS1. For example, the first power line VSS1 shown in FIG. 3 may correspond to the first branch line BRL1 shown in FIG. 8. The second transistor T2 connected to the sensing line SS(2n−1) may be symmetrical to the third transistor T3 connected to the sensing line SS2*n*. In addition, the first transistor T1 connected to the scan line SC(2n−1) may be symmetrical to the fourth transistor T4 connected to the scan line SC2*n*. The second transistor T2 and the third transistor T3 may be sensing buffer transistors. The first transistor T1 and the fourth transistor T4 may be scan buffer transistors.

Therefore, referring back to FIG. 8 and referring to FIG. 3, when the second transistor T2 is located in the first direction DR1 from the first transistor T1, the third transistor T3 is located in a direction opposite to the first direction DR1 from the fourth transistor T4. In other words, when the second transistor T2 is located below from the first transistor T1 in the first direction DR1, the third transistor T3 is located upper from the fourth transistor T4 in the first direction DR1. That is, the first transistor T1, the second transistor T2, the third transistor T3, and the fourth transistor T4 are sequentially located in the first direction DR1 from top to bottom.

Accordingly, as shown in FIG. 8, the sensing line SS(2n−1) connected to the second transistor T2 is located in the first direction DR1 from the scan line SC(2n−1) in the first stage ST(2n−1), and the sensing line SS2*n* connected to the third transistor T3 is located in a direction opposite to the first direction DR1 from the scan line SC2*n* in the second stage ST2*n*. In other words, the sensing line SS(2n−1) is located below from scan line SC(2n−1) in the first direction DR1, and the sensing line SS2*n* is located upper from scan line SC2*n* in the first direction DR1 as shown in FIG. 8.

The pixel unit 15 may be located in the second direction DR2 from the scan driver 13. Pixels PX(2n−1)m, PX(2n−1)(m+1), PX2*nm*, PX(2n+1)m, PX(2n+1)(m+1), PX(2n+2)m, and PX(2n+2)(m+1) may be located at points at which scan lines SC(2n−1), SC2*n*, SC(2n+1), and SC(2n+2) and sensing lines SS(2n−1), SS2*n*, SS(2n+1), and SS(2n+2) intersect each other.

For example, in the pixel unit 15, data lines Dm and D(m+1) may extend in the first direction DR1, and the scan lines SC(2n−1) to SC(2n+2) and the sensing lines SS(2n−1) to SS(2n+2) may extend in the second direction DR2. The pixels PX(2n−1)m to PX(2n+2)(m+1) may be arranged in a matrix form.

In general, it is required that the pixels PX(2n−1)m to PX(2n+2)(m+1) are to have the same layout, due to issues such as image quality. For example, unlike the first stage ST(2n−1) and the second stage ST2*n*, which have a symmetrical layout, it is required that a first pixel PX(2n−1)m and a second pixel PX2*nm* are to have the same layout. That is, when the sensing line SS(2n−1) connected to the first pixel PX(2n−1)m is located in the first direction DR1 from the scan line SC(2n−1), it is required that the sensing line SS2*n* connected to the second pixel PX2*nm* is to be located in the first direction from the scan line SC2*n*. In other words, when the sensing line SS(2n−1) connected to the first pixel PX(2n−1)m is located in below from the scan line SC(2n−1) in the first direction DR1, it is required that the sensing line SS2*n* connected to the second pixel PX2*nm* is also to be located below from the scan line SC2*n* in the first direction.

Therefore, it is required that the sensing line SS2*n* extending from the third transistor T3 of the second stage ST2*n* and the scan line SC2*n* extending from the fourth transistor T4 of the second stage ST2*n* are to intersect each other at an intersection point CPn as shown in FIG. 8. That is, in the exemplary embodiment shown in FIGS. 3 and 8, the first stage groups STGn and the second stage group STG(n+1) may include at least one intersection point CPn and CP(n+1).

It is highly likely that a short circuit will occur at the intersection point CPn due to a foreign substance or static electricity. In addition, although the short circuit does not occur, coupling occurs at the intersection point CPn, and therefore, crosstalk between a scan signal and a sensing signal may occur.

Figure 9:
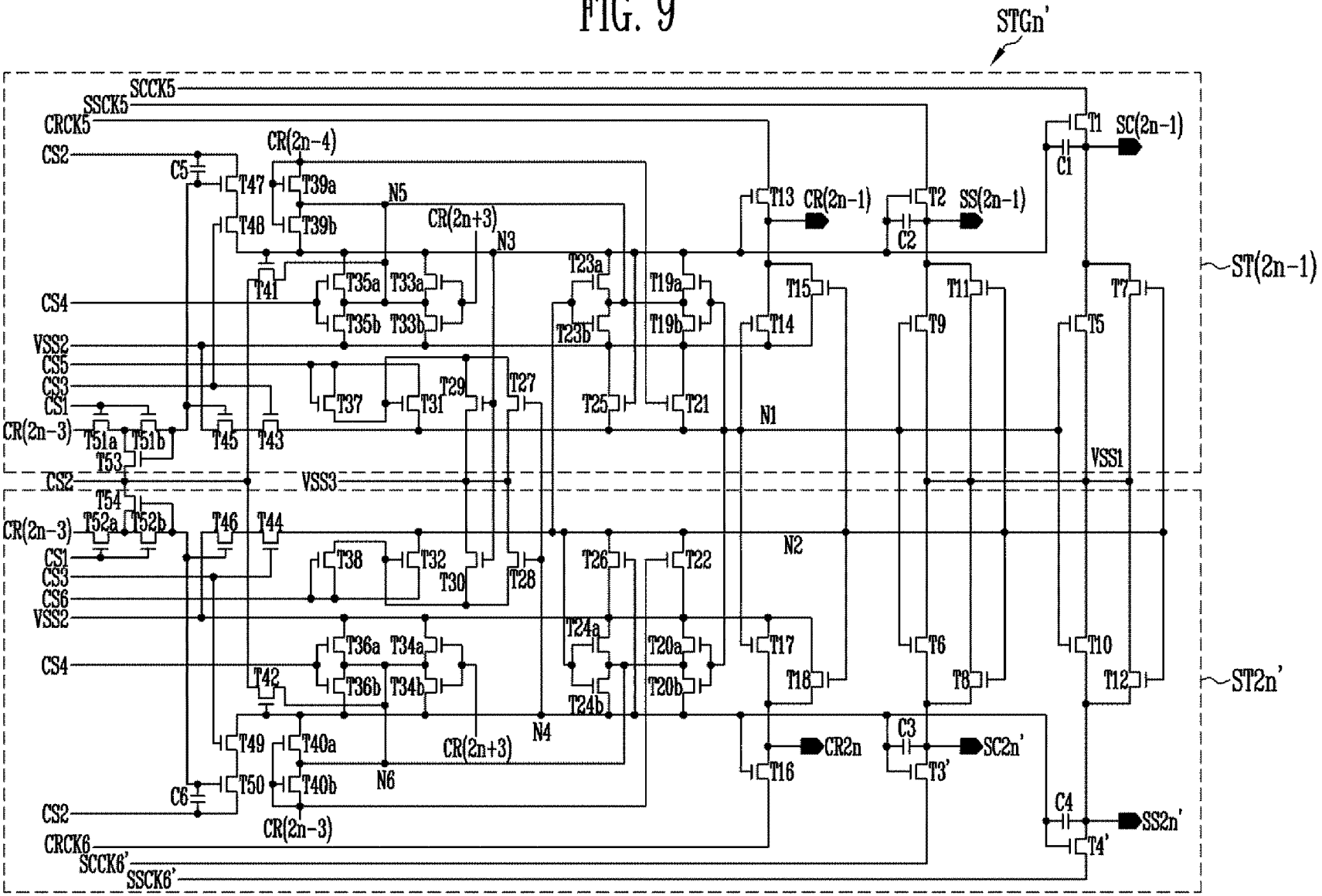
FIG. 9 is a circuit diagram of another exemplary embodiment of a stage group of the scan driver shown in FIG. 2.

FIG. 9 is a circuit diagram of another exemplary embodiment of a stage group of the scan driver shown in FIG. 2.

Referring to FIG. 9, the stage group STGn' may include a first stage ST(2n−1) and a second stage ST2*n*'. In the stage group STGn' shown in FIG. 9, a connection configuration of a third transistor T3' and a fourth transistor T4', which are included in the second stage ST2*n*', is different from that of the stage group STGn shown in FIG. 3.

A first electrode of the third transistor T3' may be connected to a scan line SC2*n*', a second electrode of the third transistor T3' may be connected to a scan clock line SCCK6, and a gate electrode of the third transistor T3' may be connected to a fourth node N4.

A first electrode of the fourth transistor T4' may be connected to a sensing line SS2*n*', a second electrode of the fourth transistor T4' may be connected to a sensing clock line SSCK6', and a gate electrode of the fourth transistor T4' may be connected to the fourth node N4.

In accordance with an exemplary embodiment, the third transistor T3' and the fourth transistor T4', which are shown in FIG. 9, may maintain specifications of the third transistor T3 and the fourth transistor T4, which are shown in FIG. 3, and have only clock lines connected thereto, which are substituted for those connected to the third transistor T3 and the fourth transistor T4.

For example, the third transistor T3 and the fourth transistor T4, which are shown in FIG. 3, may have the same channel width and the same length. In addition, the third transistor T3' and the fourth transistor T4', which are shown in FIG. 9, may have the same channel width and the same length. Therefore, although the clock lines are substituted, the role of the third transistor is changed from the sensing buffer transistor T3 to the scan buffer transistor T3', and the role of the fourth transistor is changed from the scan buffer transistor T4 to the sensing buffer transistor T4'. However, this configuration does not produce any problems when a scan signal and a sensing signal are output.

Figure 10:
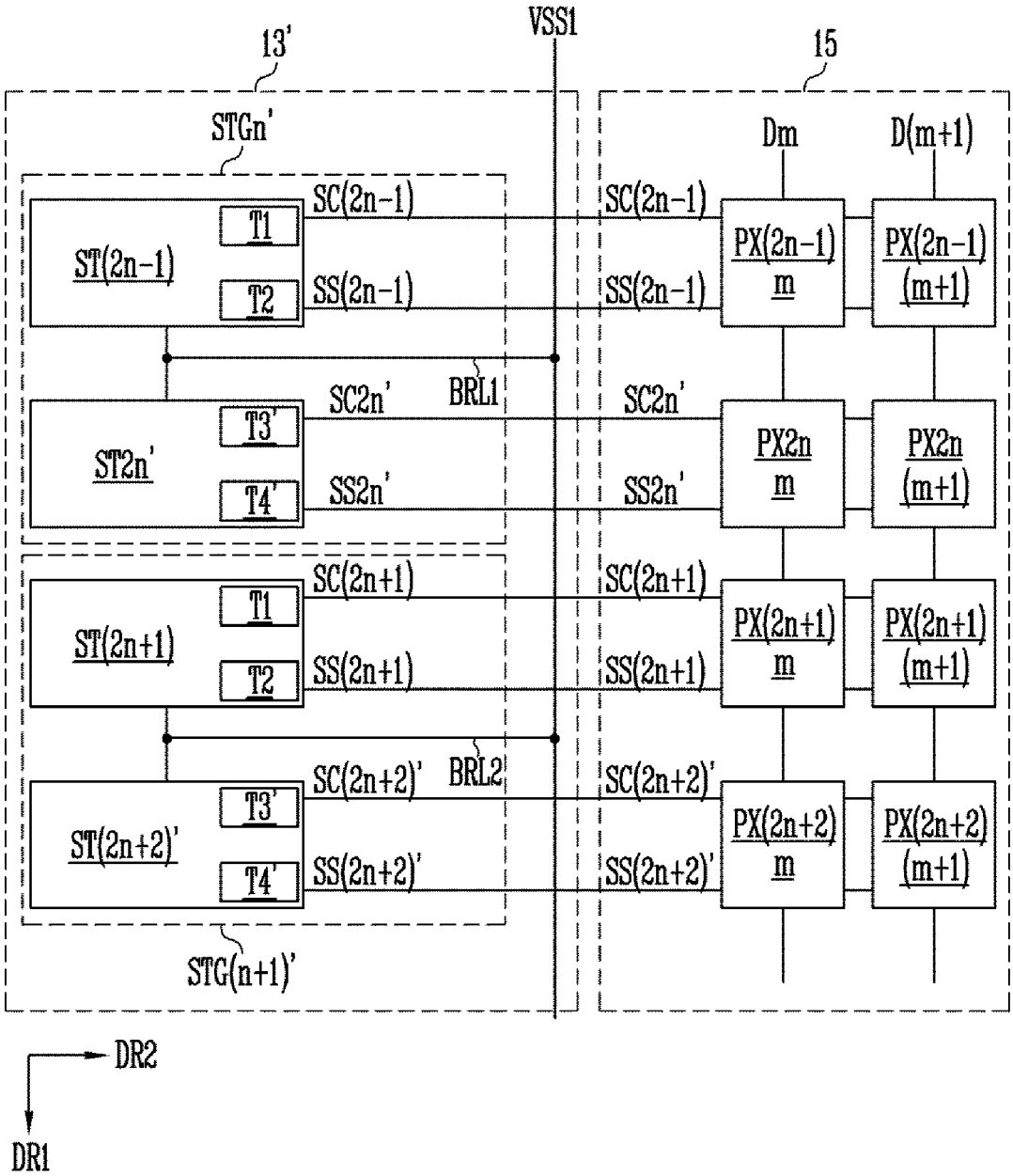
FIG. 10 is a diagram illustrating of another exemplary embodiment of a connection relationship between the scan driver and the pixel unit according to the principles of the invention.

FIG. 10 is a diagram illustrating of another exemplary embodiment of a connection relationship between the scan driver and the pixel unit according to the principles of the invention.

Referring to FIG. 10, like the case shown in FIG. 8, in each of stage groups STGn' and STG(n+1)', a first transistor T1, a second transistor T1, a third transistor T3', and a fourth transistor T4' may be sequentially located in the first direction DR1 from top to bottom.

In the scan driver 13' shown in FIG. 10, all sensing lines SS(2n−1), SS2n', SS(2n+1), and SS(2n+2)' may be located in the first direction DR1 from corresponding scan lines SC(2n−1), SC2n', SC(2n+1), and SC(2n+2)'. That is, the sensing lines SS(2n−1), SS2n', SS(2n+1), and SS(2n+2)' and the scan lines SC(2n−1), SC2n', SC(2n+1), and SC(2n+2)' do not overlap with each other, in a plane view. The plane may be defined by the first direction DR1 and the second direction DR2. Therefore, unlike FIG. 8, the stage groups STGn' and STG(n+1)' do not include any intersection point. In other words, the sensing lines SS(2n−1), SS2n', SS(2n+1), and SS(2n+2)' and the scan lines SC(2n−1), SC2n', SC(2n+1), and SC(2n+2)' do not intersect each other.

Thus, unlike the embodiment shown in FIGS. 3 and 8, in the exemplary embodiment shown in FIGS. 9 and 10, intersection between a scan line and am adjacent sensing line can be prevented, thereby reducing a defect rate.

In the scan driver and the display device including the same according to the exemplary embodiments, since adjacent stages can share a power line, the space required to accommodate the components can be decreased, and crosstalk between a scan line and an adjacent sensing line, can be prevented, thereby reducing a defect rate.

Although certain exemplary embodiments and implementations have been described herein, other embodiments and modifications will be apparent from this description. Accordingly, the inventive concepts are not limited to such embodiments, but rather to the broader scope of the appended claims and various obvious modifications and equivalent arrangements as would be apparent to a person of ordinary skill in the art.

What is claimed is:

1. A scan driver for a display device comprising:

a plurality of stage groups each including a first stage and a second stage spaced apart from the first stage in a first direction; and a first power line extending in the first direction, the first power line being commonly electrically connected to the plurality of stage groups, wherein the first power line includes a first branch line extending in a second direction intersecting the first direction between the first stage and the second stage, and the first branch line is electrically connected to the first stage and the second stage, wherein the first stage includes a first transistor including a first electrode connected to a first scan line and a second transistor including a first electrode connected to a first sensing line, wherein the second stage includes a third transistor including a first electrode connected to a second scan line and a fourth transistor including a first electrode connected to a second sensing line, and wherein the first transistor, the second transistor, the third transistor, and the fourth transistor are sequentially disposed one after the other in the first direction.

2. The scan driver of claim 1, wherein the first stage further comprises a fifth transistor including a first electrode electrically connected to the first power line by the first branch line, a second electrode connected to the first electrode of the first transistor, and a gate electrode connected to a first node, and wherein the second stage further comprises a sixth transistor including a first electrode electrically connected to the first power line by the first branch line, a second electrode connected to the first electrode of the third transistor, and a gate electrode connected to the first node.

3. The scan driver of claim 2, wherein the first stage further comprises a seventh transistor including a first electrode electrically connected to the first power line by the first branch line, a second electrode connected to the first electrode of the first transistor, and a gate electrode connected to a second node, and wherein the second stage further comprises an eighth transistor including a first electrode electrically connected to the first power line by the first branch line, a second electrode connected to the first electrode of the third transistor, and a gate electrode connected to the second node.

4. The scan driver of claim 3, wherein the first stage further comprises a ninth transistor including a first electrode electrically connected to the first power line by the first branch line, a second electrode connected to the first electrode of the second transistor, and a gate electrode connected to the first node, and wherein the second stage further comprises a tenth transistor including a first electrode electrically connected to the first power line by the first branch line, a second electrode connected to the first electrode of the fourth transistor, and a gate electrode connected to the first node.

5. The scan driver of claim 4, wherein the first stage further comprises an eleventh transistor including a first electrode electrically connected to the first power line by the first branch line, a second electrode connected to the first electrode of the second transistor, and a gate electrode connected to the second node, and wherein the second stage further comprises a twelfth transistor including a first electrode electrically connected to the first power line by the first branch line, a second electrode connected to the first electrode of the fourth transistor, and a gate electrode connected to the second node.

6. The scan driver of claim 5, wherein the first stage further comprises:

a thirteenth transistor including a first electrode connected to a first carry line;

a fourteenth transistor including a first electrode connected to a second power line, a second electrode connected to the first electrode of the thirteenth transistor, and a gate electrode connected to the first node; and a fifteenth transistor including a first electrode connected to the second power line, a second electrode connected to the first electrode of the thirteenth transistor, and a gate electrode connected to the second node.

7. The scan driver of claim 6, wherein the second stage further comprises:

a sixteenth transistor including a first electrode connected to a second carry line;

a seventeenth transistor including a first electrode connected to the second power line, a second electrode connected to the first electrode of the sixteenth transistor, and a gate electrode connected to the first node; and an eighteenth transistor including a first electrode connected to the second power line, a second electrode connected to the first electrode of the sixteenth transistor, and a gate electrode connected to the second node.

8. The scan driver of claim 7, wherein a gate electrode of the first transistor, a gate electrode of the second transistor, and a gate electrode of the thirteenth transistor are connected to a third node.

9. The scan driver of claim 8, wherein a gate electrode of the third transistor, a gate electrode of the fourth transistor, and a gate electrode of the sixteenth transistor are connected to a fourth node.

10. A display device comprising:

a first pixel connected to a first data line;

a second pixel connected to the first data line, the second pixel being spaced apart from the first pixel in a first direction;

a plurality of stage groups each including a first stage and a second stage spaced apart from the first stage in the same first direction; and a first power line extending in the first direction, the first power line being commonly electrically connected to the plurality of stage groups, wherein the first power line includes a first branch line extending in a second direction intersecting the first direction between the first stage and the second stage, and the first branch line is electrically connected to the first stage and the second stage, wherein the first stage comprises a first transistor including a first electrode connected to a first scan line and a second transistor including a first electrode connected to a first sensing line, wherein the second stage comprises a third transistor including a first electrode connected to a second scan line and a fourth transistor including a first electrode connected to a second sensing line, wherein the first transistor, the second transistor, the third transistor, and the fourth transistor are sequentially disposed one after the other in the first direction, wherein the first scan line and the first sensing line are connected to the first pixel, and wherein the second scan line and the second sensing line are connected to the second pixel.

11. The display device of claim 10, wherein the first stage further comprises a fifth transistor including a first electrode electrically connected to the first power line by the first branch line, a second electrode connected to the first electrode of the first transistor, and a gate electrode connected to a first node, and wherein the second stage further comprises a sixth transistor including a first electrode electrically connected to the first power line by the first branch line, a second electrode connected to the first electrode of the third transistor, and a gate electrode connected to the first node.

12. The display device of claim 11, wherein the first stage further comprises a seventh transistor including a first electrode electrically connected to the first power line by the first branch line, a second electrode connected to the first electrode of the first transistor, and a gate electrode connected to a second node, and wherein the second stage further comprises an eighth transistor including a first electrode electrically connected to the first power line by the first branch line, a second electrode connected to the first electrode of the third transistor, and a gate electrode connected to the second node.

13. The display device of claim 12, wherein the first stage further comprises a ninth transistor including a first electrode electrically connected to the first power line by the first branch line, a second electrode connected to the first electrode of the second transistor, and a gate electrode connected to the first node, and wherein the second stage further comprises a tenth transistor including a first electrode electrically connected to the first power line by the first branch line, a second electrode connected to the first electrode of the fourth transistor, and a gate electrode connected to the first node.

14. The display device of claim 13, wherein the first stage further comprises an eleventh transistor including a first electrode electrically connected to the first power line by the first branch line, a second electrode connected to the first electrode of the second transistor, and a gate electrode connected to the second node, and wherein the second stage further comprises a twelfth transistor including a first electrode electrically connected to the first power line by the first branch line, a second electrode connected to the first electrode of the fourth transistor, and a gate electrode connected to the second node.

15. The display device of claim 14, wherein the first stage further comprises:

a thirteenth transistor including a first electrode connected to a first carry line;

a fourteenth transistor including a first electrode connected to a second power line, a second electrode connected to the first electrode of the thirteenth transistor, and a gate electrode connected to the first node; and a fifteenth transistor including a first electrode connected to the second power line, a second electrode connected to the first electrode of the thirteenth transistor, and a gate electrode connected to the second node.

16. The display device of claim 15, wherein the second stage further comprises:

a sixteenth transistor including a first electrode connected to a second carry line;

a seventeenth transistor including a first electrode connected to the second power line, a second electrode connected to the first electrode of the sixteenth transistor, and a gate electrode connected to the first node; and an eighteenth transistor including a first electrode connected to the second power line, a second electrode connected to the first electrode of the sixteenth transistor, and a gate electrode connected to the second node.

17. The display device of claim 16, wherein a gate electrode of the first transistor, a gate electrode of the second transistor, and a gate electrode of the thirteenth transistor are connected to a third node.

18. The display device of claim 17, wherein a gate electrode of the third transistor, a gate electrode of the fourth transistor, and a gate electrode of the sixteenth transistor are connected to a fourth node.

* * * * *